US007435332B2

(12) United States Patent
Long et al.

(10) Patent No.: US 7,435,332 B2
(45) **Date of Patent: *Oct. 14, 2008**

(54) PROCESS FOR CRACKING HYDROCARBON OILS

(75) Inventors: Jun Long, Beijing (CN); Huiping Tian, Beijing (CN); Yujian Liu, Beijing (CN); Yuxia Zhu, Beijing (CN); Zhenyu Chen, Beijing (CN); Yaoqing Guo, Beijing (CN); Zhijian Da, Beijing (CN); Jiushun Zhang, Beijing (CN); Mingyuan He, Beijing (CN)

(73) Assignees: China Petroleum & Chemical Corporation, Beijing (CN); Research Institute of Petroleum Processing Sinopec, Beijing (CN)

( * ) Notice: Subject to any disclaimer, the term of this patent is extended or adjusted under 35 U.S.C. 154(b) by 560 days.

This patent is subject to a terminal disclaimer.

(21) Appl. No.: 10/949,298

(22) Filed: Sep. 27, 2004

(65) Prior Publication Data

US 2005/0279670 A1 Dec. 22, 2005

(30) Foreign Application Priority Data

Sep. 28, 2003 (CN) ..... 03 1 26446

(51) Int. Cl.
*C10G 11/00* (2006.01)
*C10G 9/00* (2006.01)

(52) U.S. Cl. ..... 208/113; 208/106; 208/120.01; 208/120.05; 208/120.1; 208/120.15; 208/120.2; 208/120.25; 208/120.35; 208/121

(58) Field of Classification Search ..... 208/106, 208/113, 120.01, 120.05, 120.1, 120.15, 208/120.2, 120.25, 120.35, 121
See application file for complete search history.

(56) References Cited

U.S. PATENT DOCUMENTS 4,280,895 A 7/1981 Stuntz et al.

(Continued)

FOREIGN PATENT DOCUMENTS

CN 1069054 2/1993

(Continued)

OTHER PUBLICATIONS

English Language Abstract of CN1078094.

(Continued)

*Primary Examiner*—Walter D. Griffin
*Assistant Examiner*—Lessanework T Seifu
(74) *Attorney, Agent, or Firm*—Birch, Stewart, Kolasch & Birch, LLP

(57) ABSTRACT

This invention relates to a process for cracking hydrocarbon oils. The process comprises contacting a hydrocarbon oil with a catalyst that has been contacted with an atmosphere containing a reducing gas, separating cracked products and the catalyst, and regenerating the catalyst. The catalyst is a cracking catalyst containing a metal component, or a catalyst mixture of a cracking catalyst containing a metal component and a cracking catalyst free of metal component. The catalyst is contacted with the atmosphere containing a reducing gas at a temperature of 100 to 900° C. for at least 1 second, and the amount of the atmosphere containing a reducing gas is not less than 0.03 cubic meters of reducing gas per ton of the cracking catalyst containing a metal component per minute, at a pressure of 0.1-0.5 MPa in the reduction reactor. The process has enhanced capability for desulfurizing and cracking heavy oils.

32 Claims, 2 Drawing Sheets

U.S. PATENT DOCUMENTS

| | | | | |
|---|---|---|---|---|
| 4,280,896 | A | 7/1981 | Bearden et al. | |
| 4,298,459 | A | 11/1981 | Tatterson et al. | |
| 4,325,811 | A * | 4/1982 | Sorrentino | 208/113 |
| 4,345,992 | A | 8/1982 | Washer et al. | |
| 4,432,863 | A * | 2/1984 | Myers et al. | 208/113 |
| 4,452,693 | A | 6/1984 | Schucker et al. | |
| 4,504,379 | A | 3/1985 | Stuntz et al. | |
| 4,504,380 | A | 3/1985 | Stuntz et al. | |
| 4,566,966 | A | 1/1986 | Pafford et al. | |
| 4,601,814 | A * | 7/1986 | Mauleon et al. | 208/113 |
| 4,623,443 | A | 11/1986 | Washer | |
| 4,666,584 | A | 5/1987 | Luckenbach et al. | |
| 4,824,814 | A * | 4/1989 | Elvin et al. | 502/22 |
| 5,089,235 | A | 2/1992 | Schwartz et al. | |
| 5,104,517 | A | 4/1992 | Lomas et al. | |
| 5,308,474 | A | 5/1994 | Cetinkaya | |
| 6,036,847 | A | 3/2000 | Ziebarth et al. | |
| 6,852,214 | B1 * | 2/2005 | Chester et al. | 208/113 |

FOREIGN PATENT DOCUMENTS

| | | |
|---|---|---|
| CN | 1020280 | 4/1993 |
| CN | 1072109 | 5/1993 |
| CN | 1031409 | 3/1996 |
| CN | 1034222 | 3/1997 |
| CN | 1194181 | 9/1998 |
| CN | 1261618 | 8/2000 |
| CN | 1281887 | 1/2001 |
| CN | 1286134 | 3/2001 |
| CN | 1295877 | 5/2001 |
| CN | 1078094 | 1/2002 |
| CN | 1334316 | 2/2002 |
| CN | 1089362 | 8/2002 |
| CN | 1428400 | 7/2003 |
| CN | 1552805 | 12/2004 |
| EP | 0052356 | 5/1982 |
| EP | 0145466 | 7/1983 |
| EP | 0139392 | 5/1985 |
| EP | 0163978 | 12/1985 |
| EP | 0564678 | 10/1992 |
| EP | 0593823 | 4/1994 |
| EP | 0798362 | 10/1997 |

OTHER PUBLICATIONS

"Residual Oil Processing Processes", Ed. by Lee Chuu-nian, China Petrochemical Publisher, 2002, pp. 282-338.
English Language Abstract of CN 1194181.
English Language Abstract of CN 1281887.
English Language Abstract of CN1261618.
English Language Abstract of CN1034222.
English Language Abstract of CN1072109.
English Language Abstract of CN1286134.
English Language Abstract of CN1089362.
English Language Abstract of CN 1295877.
English Language Abstract of CN 1334316.
English Language Abstract of CN 1020280.
English Language Abstract of CN 1031409.
English Language Abstract of CN 1069054.
English Language Abstract of CN 1428400.
English Language Abstract of CN 1552805.

* cited by examiner

PROCESS FOR CRACKING HYDROCARBON OILS

FIELD OF THE INVENTION

The present invention relates to a process for cracking hydrocarbon oils.

BACKGROUND OF THE INVENTION

Processes for cracking hydrocarbon oils generally comprise contacting and reacting hydrocarbon oils with a cracking catalyst in a cracking zone under cracking conditions, separating cracked products and the catalyst, circulating the catalyst to a regeneration zone and regenerating the catalyst therein, circulating at least a part of the regenerated catalyst back to the cracking zone. The object of regenerating the catalyst is to maintain the cracking activity of the catalyst.

Some hydrocarbon oils contain impurities, such as nickel, vanadium, iron and the like. If impurities contained in the hydrocarbon oil, such as nickel, vanadium, iron and the like, are deposited onto the catalyst containing a molecular sieve, the catalyst will thus be deactivated and the distribution of cracked products will be affected. In order to solve this problem, a reduction zone is added in some processes for cracking hydrocarbon oils.

U.S. Pat. No. 4,345,992 discloses a process for catalytically cracking of hydrocarbon oils. The process comprises contacting a hydrocarbon oil with a granular cracking catalyst in a cracking zone under cracking conditions, transferring continuously a part of said cracking catalyst to a regeneration zone where carbon deposits on the catalyst are removed by burning, then transferring continuously the regenerated catalyst to a reduction zone where said catalyst contacts with a reducing gas under such reduction conditions in which the harmful effect of impurity metals can be decreased, wherein a gas seal is used at the upstream of the reduction zone to ensure that the main portion of the unexpended reducing gas enters the cracking zone, and transferring continuously the reduced catalyst to the cracking zone. Said catalyst includes various conventional cracking catalysts, such as zeolite-containing cracking catalysts and amorphous aluminosilicate catalysts.

U.S. Pat. No. 4,623,443 discloses a process for hydrogenation of olefins. The process comprises cracking a hydrocarbon with a regenerated catalyst having a metal coat under cracking conditions in a cracking zone; transferring continuously said catalyst to a regeneration zone, contacting said catalyst with an oxygen-containing gas to regenerate said catalyst; transferring continuously a part of the regenerated catalyst to said cracking zone; meanwhile, transferring the other part of the regenerated catalyst to a reduction zone where said catalyst contacts with a reducing gas under conditions in which metals on the catalyst are reduced; transferring the cracked hydrocarbon to a separation zone where hydrogen and olefins are separated from the cracked products; contacting at least a part of said hydrogen and olefins with the reduced catalyst in a hydrogenation zone to hydrogenate the olefins; and finally transferring said catalyst to the regeneration zone.

U.S. Pat. No. 4,623,443 further discloses a process for continuous hydrogenation of olefins. The process comprises, under regeneration conditions, contacting a deactivated and metal-contaminated cracking catalyst with an oxygen-containing gas to obtain a regenerated and metal-contaminated catalyst; contacting the regenerated and metal-contaminated catalyst with a reducing gas under reduction conditions to obtain a reduced, regenerated and metal-contaminated catalyst and finally immediately contacting the reduced, regenerated and metal-contaminated cracking catalyst with a mixture of hydrogen and olefins to hydrogenate said olefins under hydrogenation conditions.

U.S. Pat. No. 4,623,443 also discloses a process for converting hydrocarbons. The process comprises (1) contacting a hydrocarbon which contains metals with an active catalyst in a reaction zone under cracking conditions to obtain cracked products and a catalyst that has been partially deactivated and metal-contaminated; (2) separating the cracked products and the partially deactivated and metal-contaminated catalyst; (3) fractionating said cracked products into hydrogen, olefins and other hydrocarbons; (4) contacting said partially deactivated and metal-contaminated cracking catalyst with an oxygen-containing gas under regeneration conditions to obtain a regenerated and metal-contaminated catalyst; (5) circulating a part of said regenerated and metal-contaminated catalyst to said reaction zone; (6) contacting the other part of the regenerated and metal-contaminated catalyst with a reducing gas under reduction conditions to obtain a reduced, regenerated and metal-contaminated catalyst; (7) contacting said reduced, regenerated and metal-contaminated catalyst with hydrogen and olefins under hydrogenation conditions to obtain hydrogenated olefins and a reduced, regenerated and metal-contaminated catalyst that is partially coked; (8) separating said hydrogenated olefins and said partially coked, reduced, regenerated and metal-contaminated catalyst; (9) circulating the hydrogenated olefins to the fraction system according to (3); (10) circulating the partially coked, reduced, regenerated and metal-contaminated catalyst to (4) to carry out regeneration.

In recent years, requirements of fuel standards worldwide become more and more stringent for the sake of environmental protection. For instance, in China, "Criteria for Controlling Hazardous Materials in Automobile Gasoline" was regulated by the National Quality Monitoring Bureau in 1999. Sulfur content in gasoline should be less than 800 ppm according to the requirement of the Criteria. More Stringent requirement of gasoline sulfur content i.e. less than 30 ppm, is regulated according to the Europe III Emission Standard of Fuel Oil. In fact, more than 90% of sulfur in gasoline are from FCC gasoline. In the other hand, more and more sour crude from the middle-east countries are processed in many Chinese refineries as FCC feedstock; meanwhile, crudes are getting more and more heavier in recent years. Therefore, there needs to develop a cracking catalyst with higher cracking activity and desulfurizing ability and a cracking process with higher ability for cracking and desulfurizing of heavy oil.

U.S. Pat. No. 6,036,847 and its European counterpart patent EP 0,798,362A2 disclose a process for fluidized catalytic cracking of hydrocarbons, wherein said hydrocarbon feedstock is cracked in a cracking zone without adding hydrogen, and all particles, including catalyst particles, are circulated continuously between a cracking zone and a regeneration zone. In said process, besides said particles, there are additional particles which have a lower activity for cracking hydrocarbon oils than the catalyst particles, said activity being based on the fresh catalyst particles. The particles consist essentially of titanium oxide and an inorganic oxide other than non-titanium oxides. Said inorganic oxide other than non-titanium oxides contains a Lewis acid supported on alumina, and the Lewis acid is one selected from the group consisting of the following elements and their compounds: nickel, copper, zinc, silver, cadmium, indium, tin, mercury, thallium, led, bismuth, boron, aluminum (non alumina) and germanium. The sulfur content of FCC gasoline as the cracked product is decreased because of the use of a titanium oxide-containing adjvuant.

SUMMARY OF THE INVENTION

An object of the present invention is to provide a novel process for cracking hydrocarbon oils having a higher ability of cracking and desulfurizing heavy oil.

The inventors of the present invention has discovered that, if metal component is introduced into a cracking catalyst and contacts with an atmosphere containing a reducing gas, not only desulfurizing activity of the cracking catalyst will be improved, but also, unexpectedly, cracking activity of the catalyst will be improved prominently. A process for cracking hydrocarbon oils using this catalyst can improve not only the desulfurizing ability but also the conversion of the hydrocarbon oils prominently.

The process according to the present invention comprises, under cracking conditions, contacting a hydrocarbon oil with a catalyst that has contacted with an atmosphere containing a reducing gas, separating cracked products and the catalyst, regenerating the catalyst, and contacting the regenerated catalyst with said atmosphere containing a reducing gas. Said hydrocarbon oil is a sulfur-containing or sulfur-free hydrocarbon oil. Said catalyst is a cracking catalyst containing a metal component or a catalyst mixture of the cracking catalyst containing a metal component and a cracking catalyst free of a metal component, wherein said metal component is present in the maximum oxidative valence state or reduction valence state. Based on said cracking catalyst containing a metal component and calculated by oxide of the metal component present in the maximum oxidative valence state, the content of the metal component is 0.1-30 wt %. Said metal component is one or more metals selected from the group consisting of non-aluminum metal of Group III A, metals of Group IVA, Group VA, Group IB, Group IIB, Group VB, Group VIB and Group VIIB, non-noble metals of Group VIII, and rare-earth metals of the Periodic Table of Elements. said catalyst contacts with the atmosphere containing a reducing gas at a temperature of from 100 to 900° C. for at least 1 second. The amount of the atmosphere containing a reducing gas is not less than 0.03 cubic meters of reducing gas per ton of the cracking catalyst containing a metal component per minute. The catalyst contacts with said atmosphere containing a reducing gas at a pressure of from 0.1-0.5 MPa.

Compared with the prior arts, the process of the present invention possesses higher desulfurizing activity, and, unexpectedly, much higher ability of cracking heavy oil.

For example, using the process of the present invention in a small scale riser reactor, when the cracking catalyst containing a metal component was used to crack a vacuum gas oil having 2.0 wt % of sulfur and a distillation range of 329-550° C., wherein the cracking catalyst contains a 30 wt % of MOY-zeolite, 34 wt % of alumina, 35 wt % of kaolin and 1 wt % of cobalt (calculated on the basis of $CO_2O_3$)), the cracked products comprised up to 73.04-75.17 wt % of gasoline and diesel oil, and 4.53-4.96 wt % of heavy oil, and the gasoline product comprised only 270-340 mg/L of sulfur. However, when the same feedstock was cracked under the same conditions by the same process without having the step of reduction, the cracked products comprised only 69.41-70.14 wt % of gasoline and diesel oil, and up to 6.04-6.37 wt % of heavy oil, and the gasoline product comprised up to 1100-1140 mg/L of sulfur.

For example, using the process of the present invention in a small scale riser reactor, when a mixed oil containing 20 wt % of atmospheric residue and 80 wt % of vacuum gas oil was cracked by a catalyst mixture of 20 wt % of said cracking catalyst containing a metal component of the present invention (30 wt % MOY-zeolite, 34 wt % alumina, 35 wt % kaolin and 1 wt % cobalt calculated by $CO_2O_3$) and 80 wt % of a catalytic cracking catalyst under trademark of MLC-500, the cracked product comprised up to 71.18 wt % of gasoline and diesel oil and only 6.22 wt % of heavy oil, and the gasoline product only comprised 300 mg/L of sulfur. However, when the same feedstock oil was cracked by the same process without having the step of reduction, the cracked products comprised only 66.8 wt % of gasoline and diesel oil, and up to 7.96 wt % of heavy oil, and the gasoline product comprised up to 900 mg/L of sulfur.

DETAILED DESCRIPTION OF THE INVENTION

1. Reduction Process

Figure 1:
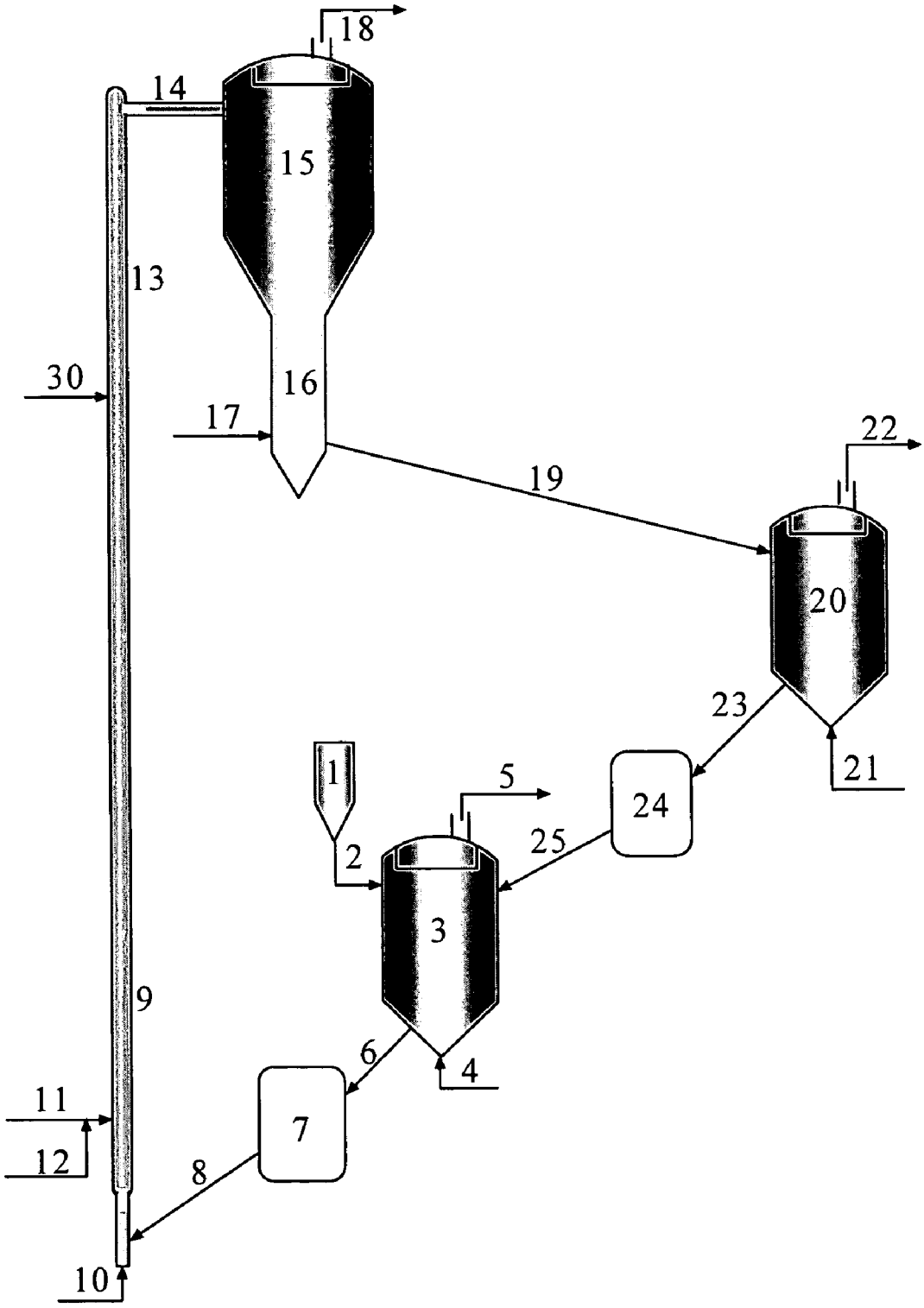
FIGS. 1 and 2 illustrate the schemes of the process provided by the present invention.

According to the process of the present invention, contacting said catalyst with an atmosphere containing a reducing gas may be carried out in situ or by circulating the catalyst to a reduction reactor, dependent upon the type of cracking reactor in which the reaction is conducted. When the cracking reactor is a fixed bed, a fluidized bed reactor or a moving-bed reactor, the catalyst is regenerated directly in situ without circulation, and then an atmosphere containing a reducing gas is introduced to contact with the catalyst. However, when a riser reactor is used as the cracking reactor, the catalyst is circulated into a regenerator, followed by circulating the regenerated catalyst into a reduction reactor where the catalyst contacts with the atmosphere containing a reducing gas.

The catalyst entering the reduction reactor may be a regenerated catalyst directly from the regenerator or a regenerated catalyst from the regenerator that has been cooled or heated after being regenerated. The catalyst that has contacted with the atmosphere containing a reducing gas may be introduced directly into a riser reactor or be introduced into a riser reactor after being cooled or heated. The regenerated catalyst and the catalyst that has contacted with the atmosphere containing a reducing gas may be cooled or heated by any present heat-exchange apparatuses, such as shell-tube exchanger, plate heat exchanger, floating coil heat exchanger and/or hot air heater. These heat-exchange apparatuses are well known for one skilled in the art.

In the reduction reactor, the catalyst may contact with the atmosphere containing a reducing gas at a temperature ranging from 100-900° C., preferably 400-700° C., for at least 1 second, preferably from 10 seconds to 1 hr, more preferably from 1-40 minutes. The amount of the atmosphere containing a reducing gas is not less than 0.03 cubic meters of the reducing gas per ton of the cracking catalyst containing a metal component per minute, preferably 0.05-15 cubic meters of the reducing gas per ton of the cracking catalyst containing metal component per minute, more preferably 1-8 cubic meters of the reducing gas per ton of the cracking catalyst containing a metal component per minute. The catalyst contacts with the atmosphere containing a reducing gas at a pressure of 0.1-0.5 MPa, preferably 0.1-0.3 MPa. Said atmosphere containing a reducing gas refers to a pure reducing gas or an atmosphere containing a reducing gas and an inert gas.

Examples of said pure reducing gas include one or more gases selected from hydrogen, carbon monoxide and hydrocarbons containing 1-5 carbon atoms, preferably one or more gases selected from hydrogen, carbon monoxide, methane, ethane, propane, butane, pentane and their isomers.

Said inert gas refers to gas that does not react with a composition or metal compounds, such as one or more gases selected from the group consisting of Group zero gases in the Periodic Table of Elements, nitrogen, and carbon dioxide.

Examples of the atmosphere containing a reducing gas and inert gas include a mixture of one or more gases selected from hydrogen, carbon monoxide, and hydrocarbons containing from 1 to 5 carbon atoms with one or more inert gases, or dry gas from refinery (e.g. catalytic cracking tail gas, catalytic reforming tail gas, hydrocracking tail gas and/or delayed coking tail gas and the like).

In said atmosphere containing a reducing gas, the concentration of the reducing gas is not particularly limited. The content of reducing gas is preferably at least 10%, more preferably 50% by volume of said atmosphere containing a reducing gas.

2. Cracking Reaction-Regeneration Process

According to the process of the present invention, the cracking reactor may be any cracking reactor, such as a fixed-bed reactor, a fluidized bed reactor, a moving-bed reactor or a riser reactor, preferably a riser reactor, such as a common riser reactor, or a riser reactor having multiple reaction zones, such as a riser reactor for fluid catalytic cracking disclosed in CN1078094C. The common riser reactor may be any common riser reactor, such as an equal-diameter riser reactor or an equal-linear speed riser reactor.

Cracking conditions are conventional catalytic cracking conditions, generally a reaction temperature of 350-700° C., preferably 400-650° C., a reaction pressure of 0.1 to 0.8 MPa, preferably from 0.1 to 0.5 MPa, a catalyst/oil weight ratio of from 1 to 30, preferably 2 to 15.

For a fixed bed, fluidized bed or moving-bed reactor, the cracking conditions include a reaction temperature of 350-700° C., preferably 400-650° C., a reaction pressure of 0.1-0.8 MPa, preferably 0.1-0.5 MPa, a WHSV of 1-40 $hr^{-1}$, preferably 2-30 $hr^{-1}$, a catalyst/oil weight ratio of 1-30, preferably 2-15. For a riser reactor, the cracking conditions include a temperature of 350-700° C., preferably 450-600° C. in the reaction zone of the riser reactor, an outlet temperature of 350-560° C., preferably 450-550° C. in the riser reactor, a reaction pressure of 0.1-0.5 MPa, preferably 0.1-0.3 MPa, a contact time of 1-10 seconds, preferably 1-6 seconds, a catalyst/oil weight ratio of 3-15, preferably 4-10.

Methods for regenerating a catalyst are well known for one skilled in the art. The object of those methods is to remove carbon deposits on a catalyst. The object is generally achieved by contacting a catalyst with an oxygen-containing gas at a temperature of 600-770° C., preferably 650-730° C. Said oxygen-containing gas refers to any oxygen-containing gas capable of removing coke on a catalyst by burning, and generally, air.

Regeneration of a catalyst can be carried out in situ or by circulating the catalyst to a regenerator, dependent upon the type of the cracking reactor. If the cracking reactor is a fixed-bed reactor, a fluidized-bed reactor or a moving-bed reactor, the catalyst can be regenerated directly in situ without being circulated. If the cracking reactor is a riser reactor, the catalyst is circulated to a regenerator and regenerated.

When the cracking reactor is a riser reactor, the process of the present invention can be performed by directly using a present reaction-regeneration system, with an addition of a reduction reactor. Various modes of a present reaction-regeneration system are well known for one skilled in the art. For example, a present reaction-regeneration system may be a side-by-side type with the same height, a side-by-side type with different heights, or a coaxial type of reaction-regeneration system, according to the arrangement of disengager and regenerator. The riser reactor can be inserted into the disengager along the axial direction of the disengager and stripping section, or an external riser reactor. Said riser reactor comprises any form of feed nozzle, a mixing temperature control device, a facility for terminating reactions, and the like. A summary description of the present catalytic cracking reaction-regeneration systems has been made in Residual Oil Processing Processes, (pp. 282-338, Ed. by Lee Chun-nian, China Petrochemical Publisher, 2002). The book describes ROCC-V process unit; a total Daqing vacuum residue catalytic cracking (VR-RFCC) process unit; a residual oil fluid catalytic cracking (RFCC) unit having a two-stage regeneration of Total Corp, US; an atmospheric heavy oil conversion RCC process unit having a two-stage regeneration jointly developed by Ashland Corp and UOP; a highly efficient regeneration FCC process unit with a coke-burning tank of UOP; a flexible riser reactor catalytic cracking unit of a combination of a riser reactor with a bed reactor of Flexicracking IIIR process of Exxon; and an one section counter flow regeneration unit and an ultra-orthoflow FCC process unit of heavy oilcracking process (HOC) of kellogg corporation. Said reaction-regeneration systems are not restricted to the aforesaid examples.

Said regenerator may be a single-stage regenerator or a two-stage regenerator. Said single-stage regenerator may be a single-stage regenerator with a turbulent bed or a single-stage regenerator with a rapid bed. Said two-stage regenerator may be a two-stage regenerator with a turbulent bed, a two-stage regenerator formed by a coke-burning tank in combination with a conventional turbulence bed, a two-stage regenerator with a rapid bed, or a tubular regenerator. Said two-stage regenerator with a turbulent bed may be a twin counter flow two-stage regenerator, or a twin cross flow two-stage regenerator. Said two-stage regenerator formed by a coke-burning tank in combination with a conventional turbulent bed may be a two-stage regenerator with a pre-positioned coke-burning tank or a two-stage regenerator with a post-positioned coke-burning tank. If desired, said regenerator may comprise an internal heat sink or external heat sink. Said internal sink may be cooling coils arranged horizontally or vertically in the bed. Said external sink may be of up-flow type, down-flow type, back-mixing flow type, or pneumatic controlled type. A summary description of regenerators has also been made in Residual Oil Processing Process, (pp. 282-338, Ed. by Lee Chun-nian, China Petrochemical Publisher 2002).

In a preferred embodiment according to the present invention, the process according to the present invention comprises contacting hydrocarbon oil with a catalyst in a riser reactor under cracking conditions, separating cracked products and the catalyst, circulating the catalyst to a regenerator to be regenerated, circulating the regenerated catalyst to a reduction reactor where the regenerated catalyst contacts with an atmosphere containing a reducing gas, and finally circulating the catalyst back to the riser reactor after the catalyst contacts with the atmosphere containing a reducing gas.

In a more specific embodiment according to the present invention, the process of the present invention can be accomplished in accordance with the scheme shown in FIG. 1.

A catalyst, which has contacted with an atmosphere containing a reducing gas from reduction reactor 3, is optionally introduced into heat exchanger 7 via line 6 to carry out heat exchange; the optionally heat-exchanged catalyst is introduced into the pre-lifting section of riser reactor 9 via line 8; said catalyst goes upward up into the reaction zone of riser reactor 9 driven by a pre-lifting steam from line 10, at the same time, the preheated hydrocarbon oil from line 11 and atomizing steam from line 12 are mixed and introduced into the reaction zone of riser reactor 9 where said hydrocarbon oil contacts with the catalyst to carry out a cracking reaction; the reaction stream keeps on moving upward through outlet zone 13 into disengager 15 of a separation system via horizontal pipe 14; the catalyst and cracked products are separated in the cyclone separator in disengager 15; the separated catalyst, which is called a spent catalyst, is introduced into stripper 16 of the separation system to contact with counter flow steam from line 17; the remaining cracked products in the spent catalyst are stripped out; the cracked products separated are mixed with stripped products and then discharged via line 18; separation of various distillates are conducted in the separation system; after being stripped, the spent catalyst is introduced into regenerator 20 via sloped tube 19; in regenerator 20, the spent catalyst contacts with an oxygen-containing atmosphere from line 21 to remove coke thereon at a regeneration temperature; flue gas is vented off via line 22; the regenerated catalyst is optionally introduced into heat exchanger 24 via line 23 to carry out heat exchange; the optionally heat-exchanged catalyst is introduced into reduction reactor 3 via line 25; in the reduction reactor 3, the regenerated catalyst or a mixture of the regenerated catalyst and a fresh catalyst via line 2 from storage tank 1 contacts with an atmosphere containing a reducing gas from line 4 under reduction conditions, and finally the waste gas is vented off via line 5.

Figure 2:
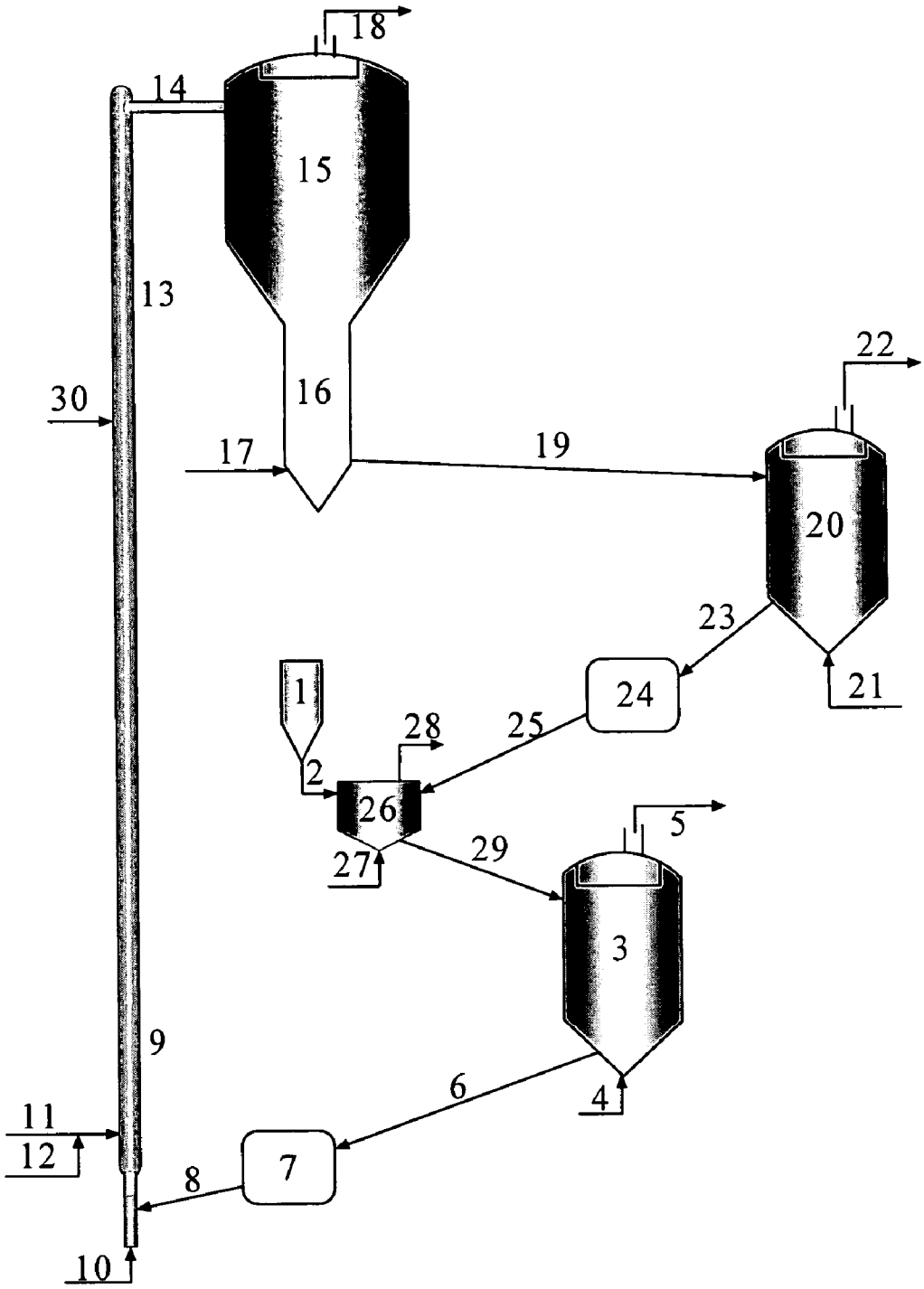

In another more specific embodiment according to the present invention, the process of the present invention can be achieved in accordance with the scheme shown in FIG. 2.

The catalyst, which has contacted with an atmosphere containing a reducing gas from reduction reactor 3, is optionally introduced into heat exchanger 7 via line 6 to carry out heat exchange; the optionally heat-exchanged catalyst is introduced into the pre-lifting section of riser reactor 9 via line 8; said catalyst goes upward into the reaction zone of riser reactor 9 driven by a pre-lifting steam from line 10, at the same time, preheated hydrocarbon oil from line 11 and atomizing steam from line 12 are mixed and introduced into the reaction zone of riser reactor 9 where said hydrocarbon oil contacts with the catalyst to carry out a cracking reaction; the reaction stream keeps on moving upward through outlet zone 13 into disengager 15 of a separation system via horizontal pipe 14; the catalyst and cracked products are separated in the cyclone separator in disengager 15; the separated catalyst, which is called a spent catalyst, is introduced into stripper 16 of the separation system to contact with counter flow steam from line 17; the remaining cracked products on the spent catalyst are stripped out; the cracked products separated are mixed with stripped products and then discharged via line 18; separation of various distillates are conducted in the separation system; after being stripped, the spent catalyst is introduced into regenerator 20 via sloped tube 19; in regeneration 20, the spent catalyst contacts with an oxygen-containing atmosphere from line 21 to remove coke thereon at a regeneration temperature; flue gas is vented off via line 22; the regenerated catalyst is optionally introduced into heat exchanger 24 via line 23 to carry out heat exchange; the optionally heat-exchanged catalyst is introduced into gas displacement tank 26 via line 25 to displace off the oxygen-containing gas entrained by the regenerated catalyst or the mixture of the regenerated catalyst with a fresh catalyst from tank 1 via line 2 with an inert gas from line 27; and waste gas is vented off via line 28; the gas-displaced catalyst is introduced into reduction reactor 3 via line 29 to contact with an atmosphere containing a reducing gas from line 4 under reduction conditions, and finally the waste gas is vented off via 5.

In said embodiment, when the temperature of the catalyst from reduction reactor 3 and regenerator 20 reaches to the reaction temperature required for reaction zone 9 or reduction reactor 3, the catalyst that has contacted with the atmosphere containing a reducing gas and the regenerated catalyst may not necessarily pass through heat exchanger 7 or heat exchanger 24.

In order to inhibit overcracking and thermal cracking reactions in outlet zone of the riser reactor, gas-solid rapid separation method may be used, or a chilling agent may be injected via line 30 into the connection region of outlet zone 13 and the reaction zone of riser reactor 9, so as to decrease the temperature of outlet zone in the riser reactor. In this way, the product distribution can be improved, and the yield of gasoline and diesel oil can be increased. The types of said chilling agent are well known for one skilled in the art. Said chilling agent may be one or more selected from the group consisting of crude gasoline, gasoline, diesel oil, cycle oils from a fractionator, and water. For gas-solid rapid separation methods, please see EP163978, EP139392, EP564678, U.S. Pat. No. 5,104,517 and U.S. Pat. No. 5,308,474. For methods of adding a chilling agent, please see U.S. Pat. No. 5,089,235 and EP593823.

The function of atomizing steam is to obtain a better effect of atomizing hydrocarbon oil, so that the hydrocarbon oil and catalyst will be mixed more homogeneously. The function of steam used as a pre-lifting media is to make the catalyst take effect more quickly so as to form a catalyst piston flow with a uniform density in the pre-lifting section. The amount of said atomizing steam and pre-lifting steam is well known for one skilled in the art. Generally, the total amount of atomizing steam and pre-lifting steam is about 1-30%, preferably 2-15% by weight of hydrocarbon oil.

The function of stripping steam is to displace oil gas filled between granules of catalyst and in granular pores so as to increase the yield of oil products. The amount of stripping steam is well known for one skilled in the art. Generally, the amount of stripping steam is 0.1-0.8%, preferably 0.2-0.4% by weight of the circulation rate of the catalyst.

The pre-lifting steam may be replaced with other pre-lifting media, such as dry gases from refining factories, light paraffin, light olefins, or mixed gases of dry gas from refining factories and steam.

Said inert gas includes any gas or gaseous mixture that does not react with a catalyst, such as nitrogen, carbon dioxide, or one or more gas selected from Group zero in the Periodic Table of Elements. The amount of said inert gas is 0.01-30 cubic meters, preferably 1-15 cubic meters, per ton catalyst per minute.

Since a small amount of catalyst will be lost after the catalyst is circulated for a given period of time, storage tank 1 plays a role of supplementing regularly or irregularly the consumed catalyst in the reaction. The metal component comprised in the catalyst in storage tank 1 may be in a reduced state or in an oxidation state.

3. Catalyst (1). Catalyst and Catalyst Mixture

In the process according to the present invention, the catalyst is a cracking catalyst containing a metal component, or a catalyst mixture of a cracking catalyst free of a metal component and a cracking catalyst containing a metal component. Said metal component may be present in the maximum oxidative valence state or as a reduction valence state. On the basis of said cracking catalyst containing a metal component and calculated by the oxide of the metal component in the maximum oxidative valence state, the content of the metal component is 0.1-30 wt %. Said metal component is one or more selected from the group consisting of non-aluminum metals of Group IIIA, metals of Group IVA, Group VA, Group IB, Group IIB, Group VB, Group VIB and Group VIIB, non-noble metals of Group VIII and rare-earth metals. On the basis of said catalyst mixture, the content of the cracking catalyst containing a metal component is at least 0.1 wt %, preferably at least 1 wt %, more preferably at least 3 wt %, desirably at least 10 wt %.

(2). Cracking Catalyst Containing a Metal Component

1) Cracking Catalyst Containing a Metal Component Present in the Maximum Oxidative Valence State Said cracking catalyst containing a metal component comprises one or more of present cracking catalysts containing a metal component, such as a cracking catalyst containing said metal components, a molecular sieve, a refractory inorganic oxide matrix, optionally a clay, and optionally a phosphor, wherein said metal is present in the maximum oxidative valence state. Based on said cracking catalyst containing a metal component and calculated by the oxide with a metal in the maximum oxidative valence state, the content of said metal component is 0.1-30 wt %, and preferably 0.5-20 wt %. The contents of the other components in said cracking catalyst containing a metal component are within the range of conventional contents of this type of catalyst, and are well known for one skilled in the art. For example, on the basis of said cracking catalyst containing a metal component, the content of said molecular sieve is 1-90 wt %, the content of the refractory inorganic oxide is 2-80 wt %, the content of the clay is 0-80 wt % and the content of phosphor is 0-15 wt % calculated by phosphorus pentoxide. Preferably, the content of said molecular sieve is 10-60 wt %, the content of the refractory inorganic oxide is 10-50 wt %, the content of the clay is 20-70 wt %, and the content of phosphor is 0-8 wt %.

Said metal component is one or more selected from the group consisting of non-aluminum metals of Group III A, metals of Group IVA, Group VA, Group IB, Group IIB, Group VB, Group VIB and Group VIIB, non-noble metals of Group VIII and rare-earth metals in the Periodic Table of Elements.

Said non-aluminum metals of Group IIIA include gallium, indium and thallium. Said metals of Group IVA include germanium, tin and led. Said metals of Group VA include antimony and bismuth. Said metals of Group IB include copper and silver. Said metals of Group IIB include zinc and cadmium, and Said metals of Group VB include vanadium, niobium and tantalum. Said metals of Group VIB include chromium, molybdenum and tungsten. Said metals of Group VIIB include manganese, technetium and rhenium. Said non-noble metals of Group VIII include iron, cobalt and nickel. Said rare-earth metal is one or more selected from the group consisting of lanthanide series and actinium series, preferably one or more selected from lanthanum, cerium, praseodymium, neodymium, promethium, samarium, europium, gadolinium, terbium, dysprosium, holmium, erbium, thulium, ytterbium, lutetium, more preferably lanthanum, cerium, lanthanum-rich norium, or cerium-rich norium. Said metal component is preferably one or more selected from gallium, germanium, tin, antimony, bismuth, led, copper, silver, zinc, cadmium, vanadium, molybdenum, tungsten, manganese, iron, cobalt nickel, lanthanum, cerium, lanthanum-rich norium or cerium-rich norium; more preferably one or more selected from gallium, tin, copper, silver, zinc, vanadium, molybdenum, manganese, iron, cobalt, lanthanum, cerium, lanthanum-rich norium or cerium-rich norium.

Said metal component is distributed simultaneously on molecular sieve, refractory inorganic oxide and clay, or on optional two of the molecular sieve, refractory inorganic oxide and clay, or on optional one of the molecular sieve, refractory inorganic oxide and clay. Preferably, Said metal component is distributed in molecular sieve, refractory inorganic oxide and clay, or in refractory inorganic oxide and/or clay.

Said molecular sieve is one or more selected from the group consisting of zeolites and non-zeolite molecular sieves serving as an active component of a cracking catalyst. These zeolites and molecular sieves are well known for one skilled in the art.

Said zeolite is preferably one or more selected from macropore zeolites and mesopore zeolites. Said macropore zeolites are those having a porous structure with at least 0.7 nanometer of ring-open, such as one or more selected from faujasite, L-zeolite, beta zeolite, Ω-zeolite, mordenite, and ZSM-18 zeolite, especially one or more selected from Y-zeolite, phosphorus- and/or rare-earth-containing Y-zeolite, ultra-stable Y-zeolite, phosphorus- and/or rare-earth-containing ultra-stable Y-zeolite, and beta zeolite.

Said mesopore zeolites are those having a porous structure with ring-open higher than 0.56 nm but less than 0.7 nm, such as one or more selected from zeolites having MFI structure (e.g. ZSM-5 zeolite), phosphorus- and/or rare-earth-containing zeolites having MFI structure (e.g. a phosphorus- and/or rare-earth-containing ZSM-5 zeolites, phosphorus-containing zeolites having MFI structure as disclosed in CN1194181A), ZSM-22 zeolite, ZSM-23 zeolite, ZSM-35 zeolite, ZSM-50 zeolite, ZSM-57 zeolite, MCM-22 zeolite, MCM-49 zeolite, and MCM 56 zeolite.

Said non-zeolite molecular sieve refers to one or more molecular sieves in which aluminum and/or silicon are partially or completely substituted by one or more other elements such as phosphor, titanium, gallium and germanium. Examples of these molecular sieves include one or more molecular sieves selected from silicates having different silica-alumina ratios (e.g. Metallosilicate and titanosilicate), metalloaluminates (e.g. germaniumaluminates), metallophosphates, aluminophosphates, metalloaluminophosphates, metal integrated silicoaluminophosphates (MeAPSO and ELAPSO), silicoaluminophosphates (SAPO), and gallogermanates. especially one or more selected from SAPO-17 molecular sieve, SAPO-34 molecular sieve and SAPO-37 molecular sieve.

Preferably, said molecular sieve is one or more selected from the group consisting of Y-zeolite, phosphorus- and/or rare-earth-containing Y-zeolite, ultra-stable Y-zeolite, phosphorus- and/or rare-earth-containing ultra-stable Y-zeolite, beta zeolite, zeolites having MFI structure, phosphorus- and/or rare-earth-containing zeolites having MFI structure.

Said refractory inorganic oxide is one or more selected from the group consisting of the refractory inorganic oxides serving as a matrix material and a binder component in cracking catalysts, such as one or more selected from the group consisting of alumina, silica, amorphous silica/alumina, zirconia, titanium oxide, boron oxide, and oxides of alkaline earth metals, preferred one or more selected from alumina, silica, amorphous silica-alumina, zirconia, titanium oxide, magnesium oxide, and calcium oxide. The refractory inorganic oxides are well known for one skilled in the art.

Said clay is one or more selected from the group consisting of clays serving as the active component of cracking catalysts, such as one or more selected from the group consisting of kaolin, halloysite, montmorillonite, kieselguhr, halloysite, soapstone, rectorite, sepiolite, attapulgus, hydrotalcite and bentonite, more preferred kaolin. These clays are well known for one skilled in the art.

The following examples of some present cracking catalysts containing a metal component are listed in non exhaustive mode:

A. A catalyst containing rare-earth Y-zeolite, ultra-stable Y-type zeolite, kaolin, and alumina, under the commercial trademark of HGY-2000R;

B. A catalyst containing rare-earth Y-zeolite, ultra-stable Y-type zeolite, kaolin, and alumina, under the a commercial trademark of MLC-500;

C. A cracking catalyst composition having desulfurization function, disclosed in U.S. Pat. No. 5,376,608;

D. A desulfurization catalyst disclosed in CN1281887A;

E. A catalyst for desulfurization of products disclosed in CN1261618A.

2). Cracking Catalyst Containing a Metal Component Present in Reduction State:

Said cracking catalyst containing a metal component further includes cracking catalysts containing a metal component in reduction state, which are specifically described in the present applicant's China Patent Application No. 03137906.0. The catalyst contains a molecular sieve, a refractory inorganic oxide, a clay and a metal component, wherein based on the total amount of the cracking catalyst containing a metal component, the content of the molecular sieve is 1-90 wt %, the content of the refractory inorganic oxide is 2-80 wt %, the content of the clay is 2-80 wt %, and the content of the metal component is 0.1-30 wt % calculated by metal oxides in the maximum oxidative valence state. Said metal component is essentially present in a reduction valence state, and is one or more selected from the group consisting of non-aluminum metals of Group IIIA, metals of Group IVA, Group VA, Group IB, Group IIB, Group VB, Group VIB and Group VIIB, and non-noble metals of Group VIII.

Said reduction valence state refers to a state in which the average valence of a metal is equal to zero or higher than zero but lower than the maximum oxidative valence state. Preferably, the ratio of the average valence to the maximum oxidative valence of said metal is 0-0.95, more preferably 0.1-0.7.

Said maximum oxidative valence state of the metal described here refers to the highest oxidation state of said metal that can be present stably in metal oxide after being adequately oxidized. For example, the maximum oxidative valence state of non-aluminum metals of Group IIIA in the Periodic Table of Elements is generally +3 valence (e.g. gallium); the maximum oxidative valence state of Group IVA metals is generally +4 valence; the maximum oxidative valence state of Group VA metals is generally +5 valence; the maximum oxidative valence state of Group IB metals is generally +2 valence (e.g. copper) or +1 valence (e.g. silver); the maximum oxidative valence state of Group IIB metals is generally +2 valence; the maximum oxidative valence state of Group VB metals is generally +5 valence; the maximum oxidative valence state of Group VIB metals is generally +6 valence; the maximum oxidative valence state of Group VIIB metals is generally +4 valence (e.g. manganese) or +7 valence (e.g. rhenium); the oxidation state of Group VIII non-noble metals is generally +3 valence (e.g. iron or cobalt) or +2 valence (e.g. nickel).

Method for measuring average valence of a metal is shown as follows:

weighing precisely about 0.4 g of a catalyst and placing it in a sample cell of TPD/R/O analysis instrument, introducing a mixed gas of hydrogen and nitrogen, in which the hydrogen content is 5% by volume, into the sample cell in a hydrogen flow rate of 20 ml/min, heating the sample cell from room temperature to 1000° C. at a speed of 10° C./min to heat and reduce the catalyst in the cell by means of a temperature programming procedure, then measuring TPR characteristic peak of the metal component in the catalyst before and after being reduced respectively, and calculating the average valence state of the metal according to formula:

$$\beta_M=\beta_{M'}-2f(A_1-A)/N$$

wherein $\beta_M$ is an average valence of the metal component M in the catalyst; $\beta_{M'}$ is the maximum oxidative valence of the metal component M in the catalyst; A is the area of TPR characteristic peak of the metal M in the catalyst when the metal component M is present in a reduction valence state; $A_1$ is the area of TPR characteristic peak of metal M in the catalyst when the metal component is present in a maximum oxidative valence state; N is the content of the metal component M in the catalyst (in moles); f is a correction factor. The method for measuring f is as follows: weighing precisely about 6.5 mg of CuO and placing it in the sample cell of aforementioned TPD/R/O analysis instrument; measuring the area $K_2$ of TPR characteristic peak of CuO which is completely reduced under the same conditions as mentioned above; calculating the hydrogen consumption $K_1$ (in moles) according to the stoichiometric number of the reduction reaction. The ratio of the hydrogen consumption to TPR characteristic peak area is f, i.e. $f=K_1/K_2$, and expressed by the unit of mole/area of TPR characteristic peak.

Since TPR characteristic peak of each metal has a different position, TPR characteristic peak of each metal can also be measured even though the catalyst contains more than two metal components.

Said metal component is one or more selected from the group consisting of non-aluminum metals of Group IIIA, metals of Groups IVA, VA, IB, IIB, VB, VIIB and VIIB, and non-noble metals of Group VIII in the Periodic Table of Elements. Said non-aluminum metals of Group IIIA include gallium, indium and thallium. Said metals of Group IVA include germanium, tin and led. Said metals of Group VA include antimony and bismuth. Said metals of Group IB include copper and silver. Said metals of Group IIB include zinc and cadmium. Said metals of Group VB include vanadium, niobium and tantalum. Said metals of Group VIB include chromium, molybdenum and tungsten. Said metals of Group VIIB include manganese, technetium and rhenium. Said non-noble metals of Group VIII include iron, cobalt and nickel. Said metal component is preferably one or more selected from gallium, germanium, tin, antimony, bismuth, led, copper, silver, zinc, cadmium, vanadium, molybdenum, tungsten, manganese, iron, cobalt and nickel, more preferably gallium, tin, copper, silver, zinc, vanadium, molybdenum, manganese, iron and cobalt.

Said metal component can be present simultaneously either in the molecular sieve, refractory inorganic oxide and clay, or in any two of the molecular sieve, refractory inorganic oxide and clay, or even in one of the molecular sieve, refractory inorganic oxides and clay. Preferably, Said metal component is distributed in molecular sieve, refratory inorganic oxide and clay, or in refratory inorganic oxide and/or clay The catalyst may further contain a rare-earth metal that may be present in form of a metal and/or a metal compound. Said rare-earth metal can be present simultaneously either in the molecular sieve, refractory inorganic oxide and clay, or in any two of the molecular sieve, refractory inorganic oxide and clay, or even in one of the molecular sieve, refractory inorganic oxide and clay. Said rare-earth metal is one or more selected from the group consisting of lanthanide-rare-earth metals and actinide-rare-earth metals, preferably one or more selected from lanthanum, cerium, praseodymium, neodymium, promethium, samarium, europium, gadolinium, terbium, dysprosium, holmium, erbium, thulium, ytterbium, lutetium, more preferably lanthanum, cerium, lanthanum-rich norium or cerium-rich norium. Based on the total amount of said cracking catalyst containing a metal component and calculated by its oxide, the content of said rare-earth metal component is 0-50 wt %, preferably 0-15 wt %.

The catalyst may further contain phosphorus component that is present in a form of a phosphorous compound, such as an oxide of phosphor and/or phosphates. Said phosphorus component can be present simultaneously either in the molecular sieve, refractory inorganic oxide and clay, or in any two of the molecular sieve, refractory inorganic oxide and clay, or even in one of the molecular sieve, refractory inorganic oxide and clay. Based on the total amount of said catalytic cracking catalyst containing metal component and calculated by phosphorus pentoxide, the content of said phosphor component is 0-15 wt %, preferably 0-8 wt %.

The types of said molecular sieve, refractory inorganic oxide and clay are the same as those described in "Cracking catalyst containing a metal component present in reduction state".

The method for preparing the catalyst comprises contacting a composition comprising a metal-containing compound, a molecular sieve, a refractory inorganic oxide and clay with an atmosphere containing a reducing gas. The contact temperature and contact time are sufficient enough to make the average valence lower than the maximum oxidative valence of said metal component. Said metal component is one or more selected from the group consisting of non-aluminum metals of Group IIIA, metals of Groups IVA, VA, IB, IIB, VB, VIIB and VIIB, and non-noble metals of Group VIII in the Periodic Table of Elements. In the composition, the content of each component is in such an amount that the final catalyst contains, based on the total amount of said cracking catalyst, 1-90 wt % molecular sieve, 2-80 wt % refractory inorganic oxide, 2-80 wt % clay and 0.1-30 wt % metal component calculated by oxide of said metal in maximum oxidative valence state.

The atmosphere containing a reducing gas refers to a pure reducing gas or an atmosphere containing a reducing gas and an inert gas.

Examples of said pure reducing gas include one or more selected from hydrogen, carbon monoxide and hydrocarbons containing 1-5 carbon atoms, preferably one or more selected from hydrogen, carbon monoxide, methane, ethane, propane, butane, pentane and their various isomers.

Said inert gas refers to a gas that does not react with said composition or metal compound, such as one or more gases selected from Group zero in the Periodic Table of Elements, nitrogen, and carbon dioxide.

Examples of said atmosphere containing a reducing gas and an inert gas include mixtures of one or more selected from hydrogen, carbon monoxide, and hydrocarbons containing 1-5 carbon atoms and one or more of inert gases, or dry gases from refining factories (e.g. catalytic cracking tail gas, catalytic reforming tail gas, hydrocracking tail gas or delayed coking tail gas and the like).

In said atmosphere containing a reducing gas, the concentration of the reducing gas is not particularly limited. Preferably, the reducing gas is at least 10% by volume, more preferably 50% by volume of said atmosphere containing a reducing gas.

Said contact temperature and contact time are sufficient enough to decrease the ratio of the average valence to the maximum oxidative valence of said metal component to 0-0.95, preferably 0.1-0.7. In general, said contact temperature may be 100-900° C., preferably 400-700° C., and said contact time may be from 0.1 second to 10 hours, preferably from 1 second to 5 hours. Said contact may be one carried out in a static state, namely that the atmosphere containing a reducing gas contacts with said composition in a sealed vessel. Said contact may also be carried out in a dynamic state, namely that said atmosphere containing a reducing gas passes through the bed of said composition. Contact pressure is not limited, so that the contact may be carried out not only at an atmospheric pressure, but also at a pressure higher than or less then atmospheric pressure. Said atmosphere containing a reducing gas is in an amount not less than 5 ml of the reducing gas per gram of the catalyst per hour, preferably not less than 10 ml of the reducing gas per gram of the catalyst per hour, more preferably 100-2000 ml of the reducing gas per gram of the catalyst per hour.

Preferably, in the composition, each component has such a content that the final catalyst contains, based on the total amount of catalyst, 10-60 wt % molecular sieve, 10-50 wt % refractory inorganic oxide, 20-60 wt % clay, and 0.5-20 wt % metal components calculated by the oxide of said metal in maximum oxidative valence state.

Said composition containing a metal component compound, a molecular sieve, a refractory inorganic oxide and a clay may be a present cracking catalyst containing a metal component, or a composition obtained by introducing a metal component compound into the cracking catalyst free of metal component.

Prior methods for preparing a cracking catalyst containing a metal component are well known for one skilled in the art, and will not be described hereinafter.

Methods for introducing a metal component compound into a cracking catalyst free of metal component are also conventional. For example, a composition containing a metal component compound, a molecular sieve, a refractory inorganic oxide and a clay may be prepared by introducing a metal component into cracking catalyst free of metal component by using the following methods.

Method No. 1

(1) a). A molecular sieve, a refractory inorganic oxide, a precursor of a refractory inorganic oxide and/or a clay are impregnated with a solution containing a metal component compound, and then are optionally dried; b). or the molecular sieve, refractory inorganic oxide, precursor of the refractory inorganic oxide and/or clay are mixed with the solution containing a metal component compound, and then are optionally dried; c). or the metal component compound is mixed physically with the molecular sieve, refractory inorganic oxides, precursor of the refractory inorganic oxides and/or clay; d). or the solution containing a metal component compound is mixed with the molecular sieve, refractory inorganic oxide, precursor of the refractory inorganic oxide and/or clay, and then a precipitant of said metal component compound is added to precipitate said metal component onto the molecular sieve, refractory inorganic oxides, precursor of the refractory inorganic oxides and/or the clay, finally the resultant mixture is optionally dried; e). or the solution containing a metal component compound is mixed with the molecular sieve, refractory inorganic oxide, precursor of the refractory inorganic oxide and/or clay, and then the slurry obtained is processed into a colloid, f). or the metal component compound insoluble in water is mixed with the molecular sieve, refractory inorganic oxide, precursor of the refractory inorganic oxide and/or clay and deionized water, the slurry obtained is processed into a colloid, and finally the colloid is optionally dried;

(2) The molecular sieve, refractory inorganic oxide, precursor of the refractory inorganic oxide and/or clay, or said mixture, or colloid that have been introduced with said metal component compound, deionized water and the molecular sieve, refractory inorganic oxide, precursor of the refractory inorganic oxide and/or clay that are free of said metal component compound are slurried to prepare a slurry having a solid content of 10-60 wt %, preferably 20-50 wt %, and then the slurry obtained is dried, and optionally calcined.

Method No. 2

The molecular sieve, refractory inorganic oxide and/or precursor of the refractory inorganic oxide, clay and deionized water are slurried to prepare a slurry having a solid content of 10-60 wt %, preferably 20-50 wt %, and then the slurry obtained is dried and optionally calcined, Then, the dried solid is impregnated with the solution containing a metal component compound, or the solution containing a metal component compound is mixed with the dried solid, and then dried and optionally calcined.

Method No. 3

The molecular sieve, refractory inorganic oxide and/or precursor of the refractory inorganic oxide, clay, deionized water are slurried with said metal component compound to prepare a slurry having a solid content of 10-50 wt %, preferably 20-50 wt %, and then the slurry is dried and optionally calcined.

If the catalyst further contains a rare-earth metal component and/or a phosphorus component, the rare-earth metal component and/or phosphorus component may be introduced separately or simultaneously with the aforementioned metal component into the catalyst by the aforementioned method, but said metal component compound should be replaced with the rare-earth compound and/or phosphorous compound. Said rare-earth metal component and/or phosphorus component may also be those contained in commercially available molecular sieve (such as rare-earth-containing and/or phosphorus-containing Y-zeolites or ultra-stable Y-zeolites).

Methods and conditions for drying after the introduction of said metal component compound and drying the slurry are well known for one skilled in the art. For example, the drying methods may be air-drying, oven-drying, air-blown drying, or spray drying. Method for drying the slurry is preferably spray drying. Temperature for drying may be in a range of from room temperature to 400° C., preferably 100-350° C. Conditions for calcining the dried slurry and the impregnated metal compound are also well known for one skilled in the art. Generally, the temperature for calcining the dried slurry and the impregnated metal compound is in the range of 400-700° C., preferably 450-650° C. The calcination is conducted at least for 0.5 hour, preferably 0.5-100 hours, more preferably 0.5-10 hours.

A precursor of a refractory inorganic oxide refers to one or more selected from substances capable of forming said refractory inorganic oxide during the preparation of said cracking catalyst. For example, a precursor of alumina may be selected from the group consisting of hydrated alumina (e.g. pseudo-boehmite) and/or alumina-sol. A precursor of silica may be one or more selected from the group consisting of silica-sol, silica gel and water glass. A precursor of amorphous silica-alumina may be one or more selected from the group consisting of silica-alumina sol, mixtures of silica-sol and alumina sol, or silica-alumina gel. A precursor of other refractory inorganic oxides may be selected from their hydroxides, such as hydroxides of zirconium, titanium, and alkaline earth metals, and boric acid.

A metal component compound may be a water-soluble compound of said metal, or a water-insoluble and/or non-soluble compound of said metal, for example, one or more nitrates, chlorides, hydroxides, oxides of metals selected from non-aluminum metals of Group IIIA, metals of Group IV, VA, IB, IIB, VB, VIIB and VIIB, and non-noble metals of Group VIII in the Periodic Table Elements, especially, gallium, tin, copper, silver, zinc, vanadium, molybdenum, manganese, iron, cobalt.

A rare-earth metal compound may be a water-soluble compound of the rare-earth metals, or a water-insoluble and/or non-soluble compound of the rare-earth metals, such as one or more compounds selected from chlorides, nitrates, hydroxides, oxides of rare-earth metals.

A phosphorous compound may be a water-soluble compound of said phosphor, or a water-insoluble and/or non-soluble compound, such as one or more selected from phosphoric acid, phosphorous acid, ammonium phosphates, alkali-metal phosphates, oxides of phosphor, and aluminum phosphate.

(3). Cracking Catalyst Free of a Metal Component

A cracking catalyst free of a metal component may be any metal-free cracking catalyst of hydrocarbons and is well known for one skilled in the art, such as hydrocarbon cracking catalyst containing a molecular sieve, a refractory inorganic oxide, optionally a clay, and optionally a phosphor and a catalyst containing ultra-stable Y-type zeolite, kaolin and alumina under an industrid trademark of ZCM-7. The content range of each component is also well known for one skilled in the art.

(4). Mixture of a Catalyst and an Additive

In the process of the present invention, a catalyst mixture may also contain one or more of cracking additives. Said cracking additive may be one or more selected from combustion promoter, $SO_X$ transforming catalysts and octane promoter. These additives are described in previous patents and non-patent documents, such as, combustion promoters disclosed in CN 1034222C, CN 1072109A and CN 1089362C, $SO_x$ transforming catalysts disclosed in CN 1286134A, CN 1295877A and CN 1334316A, and octane promoter disclosed in CN 1020280C. CN 1031409C, and the like.

4. Application of the Present Invention

The process of the present invention is suitable for catalytically cracking any hydrocarbon oils so as to increase conversion ability of heavy oils. Said hydrocarbon oils may optionally contain metal impurities such as nickel, vanadium, iron and the like. The process of the present invention is especially suitable for catalytic cracking sulfur-containing or sulfur-free hydrocarbon oils comprising less than 50 ppm of metal impurities. The process of the present invention is especially suitable for catalytically cracking sulfur-containing hydrocarbon oils comprising less than 50 ppm of metal impurities so as to increase ability of converting heavy oils and of desulfurizing gasoline distillates.

A hydrocarbon oil may be a crude oil and a distillate thereof, especially crude oil and a distillate thereof with boiling range higher than 330° C., such as, one or more selected from the group consisting of sulfur-containing or sulfur-free atmospheric residue, vacuum residue, vacuum gas oil, atmospheric gas oil, virgin gas oil, propane light/heavy deasphalted oil and coking gas oil and hydrotreated atmospheric residue, vacuum residue, vacuum gas oil, and atmospheric gas oil.

A common riser reactor that is exemplified to illustrate in details the present invention. Similar effect will be also obtained by using other reactors. Thus it should not be understood that the reactor used in the process of the present invention is only a riser reactor.

In the examples, unless otherwise stated, all heat exchangers used are a shell-tube exchangers, all regenerators used are two-stage regenerators with a pre-positioned coke-burning tank; the amount of stripping steam is about 0.4 wt % circulation rate of the catalyst; the amount of inert gas used for displacing gas is about 8 cubic meters per ton of catalyst per minute; Kaolin used is a product having a solid content of 76 wt %, manufactured by Suzhou Kaolin Corp.; pseudo-boehmite used is a product having a solid content of 62 wt % manufactured by 501 Factory in Zibo, Shandong; alumina sol used is a product having a $Al_2O_3$ content of 21 wt % manufactured by QLCC, silica sol used is a product having a $SiO_2$ content of 27 wt % manufactured by QLCC, SINOPEC; and metal component compounds used are all in a grade of chemical purity.

EXAMPLE 1

This example describes the cracking catalyst containing a metal component and the method for preparing the same according to the present invention.

Kaolin and pseudo-boehmite were mixed with an aqueous solution having a concentration of 30 wt % of cobalt nitrate, and then deionized water was added. After being mixed homogeneously, the resultant mixture was rapidly stirred and added slowly with a hydrochloric acid having a concentration of 36.5 vol %. The pH of the slurry was adjusted to 2.0. A phosphorus- and rare-earth-containing HY-zeolite (under commercial trademark of MOY, having a unit cell size of 24.59 Angstrom, 1.5 wt % of a $Na_2O$, 1.2 wt % of a phosphor calculated by phosphor pentoxide, and 8.5 wt % of a rare-earth oxide in which the content of lanthanum oxide was 4.5 wt %, the content of ceria was 1.1 wt %, and the content of other rare-earth oxides was 2.9 wt %, manufactured by Qilu Catalyst Factory, Shangdong, China) was added and mixed homogeneously. The deionized water was used in such an amount that the slurry obtained had a solid content of 25 wt %. Kaolin, pseudo-boehmite, MOY-zeolite and the aqueous solution of cobalt nitrate were used in amounts such that the weight ratio between kaolin (dry base), $Al_2O_3$, MOY-zeolite (dry base) and $CO_2O_3$ was to 35.0:34.0:30.0:1.0.

The obtained slurry was spray dried at a temperature of 150° C., and then calcined at 550° C. for 1 hour. The obtained catalyst was washed to remove sodium ion until $Na_2O$ content is less than 0.3 wt % on catalyst, then calcined at 550° C. for 1 hour before charged into a fixed bed of reduction reactor. Hydrogen was introduced into the reduction reactor at a temperature of 400° C. in a flow rate of 5 ml/minute/g.cat. to contact with a solid for 0.5 hour. Then the reactor was cooled to room temperature, and the reduced solid was taken down to obtain cracking catalyst C1 containing a metal component of this invention. The composition of catalyst C1 and the type, distribution, average valence state and the ratio of the average valence to the maximum oxidative valence state of the metal component are shown in Table 1. The catalyst compositions shown in Table 1 were obtained by calculation, and the metal component content was calculated by the oxide in the maximum oxidative valence state of said metal component.

EXAMPLE 2

This example describes the cracking catalyst containing a metal component and a method for preparing the same according to the present invention described.

Cracking catalyst C2 was obtained by using the same method for preparing a catalyst as described in example 1, except that the solid contacted with hydrogen at a temperature of 500° C. for 3 hours. The composition of catalyst C2 and the type, distribution, average valence and ratio of the average valence to the maximum oxidative valence of the metal component are shown in Table 1.

EXAMPLE 3

This example describes the cracking catalyst containing a metal component and a method for preparing the same according to the present invention.

A kaolin was impregnated by an aqueous solution having a concentration of 10 wt % of cobalt nitrate hexahydrate, wherein the weight ratio of the cobalt nitrate hexahydrate to kaolin (dry basis) is 1:0.822, then dried at 120° C., and finally calcined at 600° C. for 1 hour to obtain a Kaolin containing 2.78 wt % of $CO_2O_3$.

Cracking catalyst C3 containing a metal component was obtained by using the same method for preparing a catalyst as described in Example 1, except that the kaolin in Example 1 was replaced with a kaolin containing 2.78 wt % of $CO_2O_3$ and that no aqueous solution of cobalt nitrate was added. The composition of Catalyst C3 and the type, distribution, average valence and ratio of the average valence to the maximum oxidative valence of the metal component are shown in Table 1.

EXAMPLE 4

This example describes the cracking catalyst containing a metal component and a method for preparing the same according to the present invention.

A MOY zeolite was impregnated with an aqueous solution having a concentration of 10 wt % of cobalt nitrate hexahydrate, wherein the weight ratio of the solution to MOY zeolite (dry basis) was 1.42:1, then dried at 120° C., and finally calcined 550° C. for 1 hour to obtain a MOY zeolite containing 3.23 wt % of $CO_2O_3$.

Kaolin and pseudo-boehmite were mixed homogeneously with deionized water. The resultant mixture was rapidly stirred and added slowly with a hydrochloric acid of a concentration of 36.5 vol %. The pH of the slurry was adjusted to 2.0. A MOY zeolite containing 3.23 wt % of $CO_2O_3$ was added and mixed homogeneously. The deionized water was used in such an amount that the slurry was obtained having a solid content of 25 wt %. Kaolin, pseudo-boehmite and MOY zeolite containing 3.23 wt % of $CO_2O_3$ were used in amounts such that the weight ratio between kaolin (dry base), $Al_2O_3$, MOY-zeolite (dry base) and $CO_2O_3$ was 35.0:34.0:30.0:1.0.

The resultant slurry was spray dried at a temperature of 150° C., and then calcined at 550° C. for 1 hour to obtain cracking catalyst C4 containing a metal component. The composition of catalyst C4 and the type, distribution, average valence state and the ratio of the average valence to the maximum oxidative valence state of the metal component are shown in Table 1.

EXAMPLE 5

This example describes the said cracking catalyst containing a metal component and a method for preparing the same according to the present invention.

The catalyst C5 was obtained by the same method for preparing a catalyst as described in example 1, except that the solid did not contact with hydrogen in the fixed-bed reactor. The composition of C5 is shown in Table 1.

EXAMPLE 6

This example describes the cracking catalyst containing a metal component and a method for preparing the same according to the present invention.

The catalyst C6 was obtained by using the same method for preparing a catalyst as described in example 3, except that the solid did not contact with hydrogen in the fixed-bed reactor. The composition of C6 is shown in Table 1.

TABLE 1

| | Example No. | | | | | |
|---|---|---|---|---|---|---|
| | 1 | 2 | 3 | 4 | 5 | 6 |
| Catalyst No. | C1 | C2 | C3 | C4 | C5 | C6 |
| type of molecular sieve | MOY | MOY | MOY | MOY | MOY | MOY |
| Content of molecular sieve, wt % | 30.0 | 30.0 | 30.0 | 30.0 | 30.0 | 30.0 |
| type of refractory inorganic oxide | $Al_2O_3$ | $Al_2O_3$ | $Al_2O_3$ | $Al_2O_3$ | $Al_2O_3$ | $Al_2O_3$ |
| Content of refractory inorganic oxide, wt % | 34.0 | 34.0 | 34.0 | 34.0 | 34.0 | 34.0 |
| type of clay | Kaolin | Kaolin | Kaolin | Kaolin | Kaolin | Kaolin |
| Clay content, wt % | 35.0 | 35.0 | 35.0 | 35.0 | 35.0 | 35.0 |
| type of metal component | Co | Co | Co | Co | Co | Co |
| Content of metal component, wt % | 1.0 | 1.0 | 1.0 | 1.0 | 1.0 | 1.0 |
| Average valence of metal component | +1.5 | 0 | +1.5 | +3 | +3 | +3 |
| Ratio of average valence to maximum valence of metal component | 0.5 | 0 | 0.5 | 1 | 1 | 1 |
| Distribution of metal component | Distributed homogeneously in catalyst | Distributed homogeneously in catalyst | Distributed homogeneously in clay | Distributed homogeneously in molecular sieve | Distributed homogeneously in catalyst | Distributed homogeneously in clay |

EXAMPLE 7

This example describes the cracking catalyst containing a metal component and a method for preparing the same according to the present invention.

(1) A kaolin was impregnated with an aqueous solution having a concentration of 7.0 wt % of zinc nitrate, wherein the weight ratio of aqueous zinc nitrate solution to kaolin (dry basis) was 1:0.940, then dried at 120° C. and finally calcined at 600° C. for 1 hour to obtain a kaolin containing 3.1 wt % of ZnO.

(2) HY-zeolite having 0.3 wt % of sodium oxide content was obtained by mixing NaY-zeolite (11 wt % of $Na_2O$, a silica-alumina ratio of 5.6, manufactured by Changling Catalyst Factory, SINOPEC) was mixed with an aqueous solution of ammonium chloride having a concentration of 0.15 mole/liter, wherein the mixing ratio was 20 g of NaY-zeolite per liter of the aqueous ammonium chloride solution. The mixture was ion exchanged at 60° C. for 1 hour, and then was filtered. The filtered cake was calcined at 550° C. for 2 hours. After repeating the ion exchange and calcination twice an HY-Zeolite having 0.3 wt % of sodium oxide was obtained.

(3) The catalyst was obtained by using the same method as described in example 1, except that the kaolin in example 1 was replaced with the kaolin containing ZnO prepared in (1) and no cobalt nitrate was added; and that MOY was replaced with HY-zeolite prepared in (2). Said ZnO-containing kaolin, pseudo-boehmite, and HY-zeolite were used in such amounts that the weight ratio between kaolin (dry basis), $Al_2O_3$, HY-zeolite (dry basis) and ZnO was to 25.0:19.2:55.0:0.8. The reductive atmosphere was a mixed gas containing 50 vol % of hydrogen and 50 vol % of carbon monoxide, and the amount of the mixed gas was 10 ml/minute/g.cat. The solid contacted with the mixed gas at a temperature of 800° C. for 3 hours, and then cracking Catalyst C7 containing a metal component of this invention was obtained. The composition of catalyst C7 and the type, distribution, average valence and the ratio of the average valence to the maximum oxidative valence of metal component are shown in Table 2.

EXAMPLE 8

This example describes the cracking catalyst containing a metal component and a method for preparing the same according to the present invention.

A kaolin was impregnated with an aqueous solution having a concentration of 10 wt % of ferric nitrate, wherein the weight ratio of the aqueous ferric nitrate solution to kaolin (dry basis) was 1:1.034, then dried at 120° C., and finally calcined at 600° C. for 2 hour to obtain a kaolin containing 3.1 wt % of $Fe_2O_3$ described.

The catalyst was prepared by using the same method as in example 1, except that the said kaolin in example 1 was replaced with the aforesaid $Fe_2O_3$-containing kaolin and no cobalt nitrate was added; and that MOY was replaced with HY-zeolite prepared by step (2) in Example 7. Said $Fe_2O_3$-containing kaolin, pseudo-boehmite, HY-zeolite were used in such amounts that the weight ratio between kaolin (dry basis), $Al_2O_3$, HY-zeolite (dry basis) and $Fe_2O_3$ was to 25.0:19.2:55.0:0.8. The reductive atmosphere was a mixed gas containing 50 vol % of hydrogen and 50 vol % of carbon monoxide, and the amount of the mixed gas was 6 ml/min/g.cat. The solid contacted with the mixed gas at a temperature of 600° C. for 0.5 hours, and then cracking catalyst C8 containing a metal component was obtained. The composition of catalyst C8 and the type, distribution, average valence and ratio of the average valence to the maximum oxidative valence of the metal component are shown in Table 2.

EXAMPLE 9

This example describes the cracking catalyst containing a metal component and a method for preparing the same according to the present invention.

A mixture of a kaolin and titania was impregnated with an aqueous solution having a concentration of 20.0 wt % of copper nitrate, wherein the weight ratio between the aqueous copper nitrate solution, kaolin (dry basis) and titania was 1:0.871:0.0223, then dried at 120° C., and finally calcined at 600° C. for 2 hour to obtain a mixture of a kaolin and titania containing 8.68 wt % of CuO.

The catalyst was prepared by using the same method as described in example 1, except that said kaolin in example 1 was replaced with aforesaid CuO-containing mixture of the kaolin and titania and no cobalt nitrate was added; and that MOY was replaced with ultra-stable Y-zeolite (commercial trademark DASY, having a unit cell size of 24.45 Angstrom, a $Na_2O$ content of 1.0 wt %, manufactured by QLCC, SINOPEC). The mixture of the CuO-containing kaolin and titania, pseudo-boehmite and DASY-zeolite were used in such amounts that the weight ratio of kaolin (dry basis), $TiO_2$, $Al_2O_3$ and DASY-zeolite (dry basis) and CuO was to 39.0:1.0:26.2:30:3.8. The reductive atmosphere was a mixed gas containing 50 vol % of hydrogen and 50 vol % of carbon monoxide, and the amount the mixed gas was 5 ml/min/g.cat. The solid contacted with the mixed gas at 400° C. for 0.5 hours; and cracking catalyst C9 containing a metal component was obtained. The composition of catalyst C9 and the type, distribution, average valence and ratio of the average valence to the maximum oxidative valence of the metal component are shown in Table 2.

EXAMPLE 10

This example describes the cracking catalyst containing a metal component and a method for preparing the same according to the present invention.

A kaolin was inpregnated with an aqueous solution having a concentration of 5.0 wt % of manganese nitrate, wherein the ratio between the aqueous manganese nitrate solution and kaolin (dry basis) was 1:0.898, and then dried at 120° C., and finally calcined at 550° C. for 2 hour to obtain a kaolin containing 2.63 wt % of $MnO_2$.

The catalyst was prepared by using the same method as described in example 1, except that the kaolin in example 1 was replaced with the aforesaid $MnO_2$-containing kaolin and no cobalt nitrate was added; and that MOY was replaced with DASY-zeolite and phosphorus- and rare-earth-containing zeolite having MFI structure (commercial trademark ZRP-1, having 2.0 wt % of a phosphor content based on phosphorus pentoxide, 1.0 wt % of a rare-earth oxide, wherein the content of lanthanum oxide was 0.53 wt %, the content of ceria was 0.13 wt %, the content of the other rare-earth oxides was 0.34 wt %, the content of $Na_2O$ was less than 0.1 wt %, and the molar ratio of $SiO_2$ to $Al_2O_3$ was 60, manufactured by QLCC, SINOPEC). The $MnO_2$-containing kaolin, pseudo-boehmite, DASY-zeolite and ZRP-1 zeolite were used in such amounts that the weight ratio of kaolin (dry basis), $Al_2O_3$ and DASY-zeolite (dry basis), ZRP-1 zeolite (dry basis) and $MnO_2$ was to 37.0:27.0:30.0:5.0:1.0. The reductive atmosphere was a mixed gas containing 80 vol % of hydrogen and 20 vol % of propane, and the amount of the mixed gas was 7.5 ml/min/g.cat. The solid contacted with the mixed gas at a temperature of 500° C. for 1 hour, and cracking catalyst C10 containing a metal component was obtained. The composition of catalyst C10 and the type, distribution, average valence and ratio of the average valence to the maximum oxidative valence of the metal component are shown in Table 2.

TABLE 2

| Example No. | 7 | 8 | 9 | 10 |
|---|---|---|---|---|
| Catalyst No. | C7 | C8 | C9 | C10 |
| Type of molecular sieve | HY | HY | DASY | DASY/ZRP-1 |
| Content of molecular sieve, wt % | 55.0 | 55.0 | 30.0 | 35.0 |
| Type of refractory inorganic oxide | $Al_2O_3$ | $Al_2O_3$ | $Al_2O_3/TiO_2$ | $Al_2O_3$ |
| Content of refractory inorganic oxide, wt % | 19.2 | 19.2 | 27.2 | 27.0 |
| Type of clay | kaolin | kaolin | kaolin | kaolin |
| Clay content, wt % | 25.0 | 25.0 | 39.0 | 37.0 |
| Type of metal component | Zn | Fe | Cu | Mn |
| Content of metal component, wt % | 0.8 | 0.8 | 3.8 | 1.0 |
| Average valence of metal component | +1.4 | +2.0 | +0.6 | +1.5 |
| Ratio of average valence to maximum valence of metal component | 0.70 | 0.67 | 0.3 | 0.38 |
| Distribution of metal component | Distributed homogeneously in clay | Distributed homogeneously in clay | Distributed in clay and refractory inorganic oxide | Distributed homogeneously in clay |

EXAMPLE 11

This example describes the cracking catalyst containing a metal component and a method for preparing the same according to the present invention.

A mixture of kaolin and kieselguhr (a solid content of 85.0 wt %, produced by Huali Kieselguhr Factory ChenZhou, Zhejiang Province) was impregnated with an aqueous solution having a concentration of 5.0 wt % of ammonium molybdate ($(NH_4)_6Mo_7O_{24}.4H_2O$), and then dried at 120° C. The mixture was further impregnated with an aqueous solution having a concentration of 2.0 wt % of silver nitrate, wherein the weight ratio between the aqueous ammonium molybdate solution, kaolin (dry basis), kieselguhr(dry basis), and the aqueous silver nitrate solution was 1:0.932:0.155:0.747, then dried at 120° C., and finally calcined at 600° C. for 2 hours to obtain a mixture of kaolin and kieselguhr, which contained 3.58 wt % of $MoO_3$ and 0.90 wt % of $Ag_2O$.

The catalyst was prepared by using the same method as described in example 1, except that the kaolin in example 1 was replaced with said $MoO_3$- and $Ag_2O$-containing mixture of kaolin and kieselguhr and no cobalt nitrate was added, and that the $MoO_3$- and $Ag_2O$-containing mixture of kaolin and kieselguhr, pseudo-boehmite, MOY-zeolite were used in such amounts that the weight ratio between the mixture of kaolin and kieselguhr (dry t basis), $Al_2O_3$, MOY-zeolite (dry basis), $MoO_3$ and $Ag_2O$ was 32.0:21.5:45.0:1.2:0.3. The reductive atmosphere was a mixed gas of nitrogen and 50 vol % hydrogen, and the amount of the mixed gas was 12.5 ml/min/g.cat. The solid contacted with the mixed gas at 650° C. for 1 hour, and cracking catalyst C11 containing a metal component was obtained. The composition of catalyst C11 and the type, distribution, average valence and ratio of the average valence to the maximum oxidative valence of metal component are shown in Table 3.

EXAMPLE 12

This example describes the cracking catalyst containing metal components and a method for preparing the same according to the present invention.

A mixture of kaolin and magnesium oxide, while being stirred, was impregnated with an aqueous solution having a concentration of 2.0 wt % of ammonium metavanadate ($NH_4VO_3$), wherein the weight ratio among the aqueous ammonium metavanadate solution ($NH_4VO_3$), kaolin (dry basis) and MgO was 1:1.011:0.027, and the resultant slurry was dried at 120° C. and calcined at 550° C. for 2 hours to obtain a kaolin containing 2.46 wt % of MgO and 1.48 wt % of $V_2O_5$.

The catalyst was prepared by using the same method as described in example 1, except that the kaolin in example 1 was replaced with said MgO- and $V_2O_5$-containing kaolin and no cobalt nitrate was added; and that MOY-zeolite was replaced with DASY-zeolite (the same as that in example 9). MgO- and $V_2O_5$-containing kaolin, pseudo-boehmite and DASY-zeolite were used in such amounts that the weight ratio among MgO- and $V_2O_5$-containing kaolin (dry basis), magnesium oxide, $Al_2O_3$, DASY-zeolite (dry basis) and $V_2O_5$ was 39.0:1.0:24.4:35.0:0.6. The solid contacted with hydrogen at 550° C. for 1 hour, and cracking catalyst C12 containing metal components was obtained. The composition of Catalyst C12, the type, distribution, average valence and ratio of the average valence to the maximum oxidative valence of metal component are shown in Table 3.

EXAMPLE 13

This example describes the cracking catalyst containing a metal component and a method for preparing the same according to the present invention.

A, mixture of kaolin and pseudo-boehmite was impregnated with an aqueous solution having a concentration of 40 wt % of gallium chloride, wherein the weight ratio among the aqueous gallium chloride solution, kaolin and pseudo-boehmite was 1:1.095:0.314, then dried at 120° C., and finally calcined at 600° C. for 2 hours to obtain a mixture of kaolin with alumina, which contained 13.1 wt % of $Ga_2O_3$.

The mixture of kaolin containing $Ga_2O_3$ and alumina, silica-sol and deionized water were mixed homogeneously, and then DASY-zeolite and ZRP-1 zeolite were added and mixed homogeneously. The deionized water was used in such an amount that the slurry had a solid content of 25 wt %. The mixture of kaolin containing $Ga_2O_3$ and alumina, silica-sol, ultra-stable Y-zeolite and ZRP-1 zeolite were used in such amounts that the weight ratio between kaolin (dry t basis), alumina, silica, DASY-zeolite (dry basis), ZRP-1 zeolite (dry basis) and $Ga_2O_3$ was 35.0:10:13.2:30:5:6.8.

The slurry was spray dried at a temperature of 150° C., and then calcined at 550° C. for 2 hours. The solid obtained was placed in a fixed bed of a reduction reactor, and hydrogen was introduced through the reactor at a temperature of 600° C. in a flow rate of 15 mL/min/g.cat. to contact said solid for 2 hours. After the reactor was cooled to room temperature, the reduced solid was taken down and cracking catalyst C13 containing a metal component was obtained. The composition of catalyst C13 and the type, distribution, average valence and ratio of the average valence to the maximum oxidative valence of the metal component are shown in Table 3.

EXAMPLE 14

This example describes the cracking catalyst containing a metal component and a method for preparing the same according to the present invention.

An aqueous solution having a concentration of 6.0 wt % of stannous chloride ($SnCl_2$) was mixed homogeneously with silica-sol and kaolin, wherein the weight ratio among the aqueous stannous chloride $SnCl_2$ solution, silica-sol (dry basis) and kaolin (dry basis) was 1:0.191:0.954, then dried at 120° C., and finally calcined at 550° C. for 3 hours to obtain a mixture of kaolin having 4.0 wt % of $SnO_2$ and silica.

The mixture of $SnO_2$-containing kaolin and silica, alumina-sol and deionized water were mixed homogeneously, and then DASY-zeolite and ZRP-1 zeolite were added and mixed homogeneously. The deionized water was used in such an amount that the slurry obtained had a solid content of 25 wt %. The mixture of $SnO_2$-containing kaolin and silica, alumina-sol, DASY and ZRP-1 zeolite were used in such amounts that the weight ratio between kaolin (dry basis), alumina, silica, DASY-zeolite (dry basis), ZRP-1 zeolite (dry basis) and $SnO_2$ was 40.0:20.0:8.0:25:5:2.0. The obtained slurry was spray dried at a temperature of 150° C., and then was calcined at 550° C. for 2 hours.

The obtained solid was placed in a fixed bed of a reduction reactor, and then hydrogen was introduced through the reactor at a temperature of 650° C. in a flow rate of 5 ml/min/g.cat. to contact with said solid for 1 hour. After the reactor was cooled to room temperature, and the reduced solid was taken down and cracking catalyst C14 containing a metal component was obtained. The composition of catalyst C14 and the type, distribution, average valence and ratio of the average valence to the maximum oxidative valence of metal component are shown in Table 3.

TABLE 3

| Example No. | 11 | 12 | 13 | 14 |
|---|---|---|---|---|
| Catalyst No. | C11 | C12 | C13 | C14 |
| Type of molecular sieve | MOY | DASY | DASY/ZRP-1 | DASY/ZRP-1 |
| Content of molecular sieve, wt % | 45.0 | 35.0 | 35.0 | 30.0 |
| Type of refractory inorganic oxide | $Al_2O_3$ | $Al_2O_3/MgO$ | $Al_2O_3/SiO_2$ | $Al_2O_3/SiO_2$ |
| Content of refractory inorganic oxide, wt % | 21.5 | 25.4 | 23.2 | 28.0 |
| Type of clay | kaolin/kieselguhr | kaolin | kaolin | kaolin |
| Clay content, wt % | 32.0 | 39.0 | 35.0 | 40.0 |
| Type of metal component | Mo/Ag | V | Ga | Sn |
| Content of metal component, wt % | 1.2/0.3 | 0.6 | 6.8 | 2.0 |
| Average valence of metal component | +3.0/0 | +2.3 | +1.5 | +2.2 |
| Ratio of average valence to maximum valence of metal component | 0.5/0 | 0.46 | 0.5 | 0.55 |
| Distribution of metal component | Distributed homogeneously in clay | Distributed homogeneously in clay and refractory inorganic oxide | Distributed in clay and refractory inorganic oxide | Dispersed in clay and refractory inorganic oxide |

EXAMPLES 15-20

The following examples describe the process according to the present invention.

According to the scheme shown in FIG. 1, feedstock oil1# shown in Table 4 was catalytically cracked. The cracking reactor 9 was a small scale riser reactor and catalysts $C_1$-$C_6$ were used respectively.

A catalyst that had contacted with an atmosphere containing a reducing gas from reduction reactor 3 was optionally introduced into heat exchanger 7 via line 6 to carry out heat exchange. The optionally heat-exchanged catalyst was introduced into the pre-lifting section of riser reactor 9 via line 8. Said catalyst was driven by pre-lifting steam from line 10 to go upward into the reaction zone of riser reactor 9. Meanwhile, a preheated hydrocarbon oil from line 11 was mixed with atomizing steam from line 12 and then introduced into the reaction zone of riser reactor 9, where said hydrocarbon oil contacted with the catalyst to carry out a cracking reaction. The reaction stream kept on moving upward through outlet zone 13 into disengager 15 of a separation system via horizontal pipe 14. In the cyclone separator of disengager 15, the catalyst and cracked products were separated. The separated catalyst, which is called a spent catalyst, was introduced into stripper 16 of the separation system, where the spent catalyst contacted in counter flow with steam from line 17 to strip out the cracked products remained on the spent catalyst. The separated cracked products and stripped products were mixed, then discharged via line 18, and the separation of various distillates were continued in the separation system. After being stripped, the spent catalyst was introduced into regenerator 20 via sloped tube 19. In regenerator 20, the spent catalyst contacted with an excessive amount of air from line 21 to remove the coke thereon at a regeneration temperature, and the flue gas was vented off via line 22. The regenerated catalyst was optionally introduced into heat exchanger 24 via line 23 to carry out heat exchange. The optionally heat-exchanged catalyst was introduced into reduction reactor 3 via line 25. In reduction reactor 3, the regenerated catalyst or the mixture of the regenerated catalyst with a fresh catalyst via line 2 from tank 1 was contacted with an atmosphere containing a reducing gas from line 4 under reduction conditions, and the waste gas was vented off via line 5. Operational conditions are shown in Table 5. Sulfur content in gasoline was determined by gas chromatography-atomic emission spectrometry with HP 6890GC-G2350A AED.

COMPARATIVE EXAMPLES 1 to 2(DB1-DB2)

The following comparative examples describes reference processes.

According to the methods of examples 19 and 20, the same feedstock oils were catalytically cracked with the same catalysts, except that the catalyst introduced into reduction reactor 3 did not contact with the atmosphere containing a reducing gas, namely that no atmosphere containing a reducing gas was introduced from line 4. Operational conditions are shown in Table 5 and the results are shown in Table 6.

TABLE 4

| Feedstock oil number | 1# | 2# | 3# |
|---|---|---|---|
| Type of feedstock oil | Vacuum gas oil | Atmospheric residue | Vacuum gas oil |
| Density (20° C.), g/cm$^3$ | 0.9154 | 0.8906 | 0.873 |
| Viscosity, mm$^2$/sec | | | |
| 50° C. | 34.14 | — | — |
| 100° C. | 6.96 | 24.84 | 8.04 |
| Asphaltenes, wt % | 0.0 | 0.8 | 0.0 |
| Conradson carbon residue content, wt % | 0.18 | 4.3 | 0.15 |
| S, wt % | 2.0 | 0.13 | 0.07 |
| Metal impurities content, ppm | 0.4 | 40 | — |
| Distillation range, ° C. | | | |
| IBP | 329 | 282 | 346 |
| 10% | 378 | 370 | 411 |
| 50% | 436 | 553 | 462 |
| 90% | 501 | — | 523 |
| 95% | 518 | — | — |
| FBP | 550 | — | 546 |

TABLE 5

| | | Example No. | | | | | | | |
|---|---|---|---|---|---|---|---|---|---|
| | | 15 | 16 | 17 | 18 | 19 | 20 | DB1 | DB2 |
| Catalyst No. | | C1 | C2 | C3 | C4 | C5 | C6 | C5 | C6 |
| Reaction zone of riser reactor 9 | Temperature, ° C. | 510 | 510 | 505 | 510 | 510 | 510 | 510 | 510 |
| | Pressure, MPa | 0.15 | 0.15 | 0.15 | 0.15 | 0.15 | 0.15 | 0.15 | 0.15 |
| | Contact time, Sec | 4 | 3.5 | 4 | 4 | 4 | 4 | 4 | 4 |
| | Catalyst/Oil ratio | 4.5 | 5 | 5.5 | 4.5 | 4.5 | 4.5 | 4.5 | 4.5 |
| Temperature of outlet zone 13, ° C. | | 495 | 490 | 495 | 495 | 495 | 495 | 495 | 495 |
| Temperature of regenerator 20, ° C. | | 690 | 700 | 690 | 700 | 700 | 700 | 700 | 700 |
| Reduction reactor 3 | Temperature, ° C. | 500 | 530 | 500 | 550 | 550 | 550– | — | — |
| | Time, min | 20 | 30 | 30 | 30 | 30 | 30– | — | — |
| | Pressure, MPa | 0.13 | 0.13 | 0.13 | 0.13 | 0.13 | 0.13– | — | — |
| | Atmosphere containing a reducing gas | $H_2$ | $H_2$ | $H_2$ | $H_2$ | $H_2$ | $H_2$ | — | — |
| | Amount of atmosphere containing a reducing gas, $m^3$/ton/min | 6.5 | 7.5 | 7 | 7 | 7 | 7– | — | — |
| Total amount of atomizing and pre-lifting steam, wt % of hydrocarbon oils | | 5 | 10 | 5 | 5 | 5 | 5 | 5 | 5 |
| Whether it is introduced into heat exchanger 7 to carry out heat exchange | | No | No | No | Yes | Yes | Yes | Yes | Yes |
| Whether it is introduced into heat exchanger 24 to carry out heat exchange | | Yes | Yes | Yes | Yes | Yes | Yes | Yes | Yes |

TABLE 6

| | Example No. | | | | | | | |
|---|---|---|---|---|---|---|---|---|
| | 15 | 16 | 17 | 18 | 19 | 20 | DB1 | DB2 |
| Catalyst No. | C1 | C2 | C3 | C4 | C5 | C6 | C5 | C6 |
| Product distribution, wt % | | | | | | | | |
| Dry gas | 3.62 | 3.43 | 3.73 | 4.05 | 3.98 | 4.03 | 4.19 | 4.25 |
| LPG | 12.43 | 12.92 | 12.62 | 13.14 | 13.09 | 13.42 | 13.29 | 13.06 |
| Gasoline | 49.42 | 49.33 | 49.34 | 48.07 | 48.32 | 48.16 | 46.35 | 46.10 |
| Diesel oil | 25.75 | 25.74 | 25.31 | 24.29 | 25.39 | 24.88 | 23.79 | 23.31 |
| Heavy oil | 4.80 | 4.53 | 4.84 | 5.13 | 4.96 | 4.83 | 6.04 | 6.37 |
| Coke | 3.98 | 4.05 | 4.16 | 5.32 | 4.26 | 4.68 | 6.34 | 6.91 |
| Sulfur content in gasoline, ml/g | 310 | 270 | 300 | 570 | 340 | 330 | 1100 | 1140 |

It can be seen from Table 6 that compared with the comparative processes, by using the process of the present invention the yields of gasoline and diesel oil increase prominently, the yield of heavy oil decreases prominently and the sulfur content in gasoline decreases to a great extent. Particularly, when the metal component in the catalyst is present in a molecular sieve, refractory inorganic oxides and clay, or in refractory inorganic oxides and/or caly, this effect is unexpectedly obvious.

EXAMPLES 21-24

The following examples describe the process of the present invention.

Hydrocarbon oil was catalytically cracked h according to the process of example 15, except that the catalysts used were catalysts C7-C10 prepared in examples 7-10 respectively, that said heat exchanger 7 was a hot air heater, that said hydrocarbon oil was the feedstock oil 3# shown in Table 4 and that operational conditions also were different. The operational conditions are shown in table 7 and the results are shown in Table 8.

COMPARATIVE EXAMPLE 3(DB3)

The following comparative example describe the reference process.

According to the process of example 24, the same feedstock oil was catalyticaly cracked by the same catalyst, except that the catalyst introduced into reduction reactor 3 did not contact with the atmosphere containing a reducing gas, namely that no atmosphere containing a reducing gas was introduced from line 4. Optional conditions are shown in Table 7, and the results are shown in Table 8.

TABLE 7

| | | Example No. | | | | |
|---|---|---|---|---|---|---|
| | | 21 | 22 | 23 | 24 | DB3 |
| Catalyst No. | | C7 | C8 | C9 | C10 | C10 |
| Reaction zone of riser reactor 9 | Temperature, ° C. | 525 | 510 | 520 | 510 | 510 |
| | Pressure, MPa | 0.25 | 0.25 | 0.25 | 0.25 | 0.25 |
| | Contact time, sec | 3.5 | 3.5 | 3.5 | 4 | 4 |
| | Catalyst/Oil ratio | 5 | 4.5 | 5 | 5 | 5 |
| Temperature of outlet zone 13, ° C. | | 500 | 497 | 490 | 490 | 490 |
| Temperature of regenerator 20, ° C. | | 680 | 680 | 680 | 710 | 710 |
| Reduction reactor 3 | Temperature, ° C. | 430 | 480 | 540 | 480 | — |
| | Time, min | 30 | 15 | 3 | 30 | — |
| | Atmosphere containing a reducing gas | 50% $H_2$ + 50% CO | 50% $H_2$ + 50% CO | 50% $H_2$ + 50% CO | 80% $H_2$ + 20% propane | — |
| | Pressure, MPa | 0.23 | 0.23 | 0.23 | 0.23 | — |
| | Amount of atmosphere containing a reducing gas, $m^3$/ton/min | 6 | 6 | 8 | 7 | — |
| Total amount of atomizing and pre-lifting steam, wt % of hydrocarbon oils | | 10 | 10 | 10 | 12 | 12 |
| Whether it is introduced into heat exchanger 7 to carry out heat exchange | | Yes | Yes | No | Yes | Yes |
| Whether it is introduced into heat exchanger 24 to carry out heat exchange | | Yes | Yes | Yes | Yes | Yes |

TABLE 8

| | Example No. | | | | |
|---|---|---|---|---|---|
| | 21 | 22 | 23 | 24 | DB3 |
| Catalyst No. | C7 | C8 | C9 | C10 | C10 |
| Product distribution, wt % | | | | | |
| Dry gas | 3.96 | 3.48 | 3.86 | 3.96 | 3.18 |
| LPG | 13.02 | 12.36 | 12.12 | 12.42 | 12.42 |
| Gasoline | 49.09 | 49.71 | 49.3 | 49.28 | 48.79 |
| Diesel oil | 25.24 | 25.6 | 25.16 | 25.22 | 24.35 |
| Heavy oil | 4.83 | 4.91 | 5.63 | 5.07 | 6.14 |
| Coke | 3.86 | 3.94 | 3.93 | 4.05 | 5.12 |

It can be seen from Table 8 that, compared with the reference process, catalytically cracking essentially sulfur-free hydrocarbon oil by using the process of the present invention, the yields of gasoline and diesel oil increase prominently, the yield of heavy oil and the content of coke decrease prominently. The results show that the process of the present invention is also suitable for catalytically cracking a sulfur-free hydrocarbon oil, and has much higher ability of cracking heavy oil.

EXAMPLES 25-28

The following examples describe the process of the present invention.

According to the scheme shown in FIG. 2, the feedstock oil 1# shown in Table 4 was catalytically cracked, wherein the cracking reactor 9 was a small scale riser reactor and catalysts C11-C14 were used respectively.

The catalyst that had contacted with an atmosphere containing a reducing gas from reduction reactor 3 was optionally introduced into heat exchanger 7 via line 6 to carry out heat exchange. The optionally heat-exchanged catalyst was introduced into the pre-lifting section of riser reactor 9 via line 8. Said catalyst was driven by pre-lifting steam from line 10 to move upward into the reaction zone of riser reactor 9. Meanwhile, preheated hydrocarbon oil from line 11 was mixed with atomizing steam from line 12 and then introduced into the reaction zone of riser reactor 9, where said hydrocarbon oil contacted with the catalyst to carry out a cracking reaction. A chilling agent was injected into the region connecting the reaction zone of riser reactor 9 with outlet zone 13 from line 30 (essentially at a place 30% of the height from the top of the riser reactor). The chilling agent was a crude gasoline at room temperature with a distillation range of 121-250° C. and in such an amount that the reaction temperature of the reaction stream in outlet zone 13 decreased a temperature shown in Table 9. The reaction stream kept on moving upward and was mixed with the chilling agent. The mixture passed through outlet zone 13 and entered into disengager 15 of a separation system via horizontal pipe 14. The catalyst and cracked products were separated in disengager 15 by the cyclone separator. The separated catalyst, which is called a spent catalyst, was introduced into stripper 16 of the separation system, where the spent catalyst contacted in counter flow with a steam from line 17 to strip out cracked products remained on the spent catalyst. The separated cracked products and stripped products were mixed, and then discharged via line 18 to continue separating out various distillates in the separation system. After being stripped, the spent catalyst was introduced into regenerator 20 via slope tube 19. In regenerator 20, the spent catalyst contacted with an excessive amount of air from line 21 so that coke thereon was removed at a regeneration temperature, and flue gas was vented off via line 22. The regenerated catalyst was optionally introduced into heat exchanger 24 via line 23 to carry out heat exchange, and the optionally heat-exchanged catalyst was introduced into gas displacement tank 26 via line 25. Meanwhile, in the gas displacement tank 26, a fresh catalyst was added from tank 1 via line 2 in an amount corresponding to 5 wt % of the regenerated catalyst. In gas displacement tank 26, the oxygen-containing gas entrained by the regenerated catalyst and the fresh catalyst was displaced out with an inert gas from line 27, and waste gas was vented off via line 28. The gas-displaced catalyst was introduced into reduction reactor 3 via line 29 to contact with an atmosphere containing a reducing gas from line 4 under reduction conditions, and waste gas was vented off via 5. Operational conditions are shown in Table 9 and results are shown in Table 10.

TABLE 9

| | | Example No. | | | |
|---|---|---|---|---|---|
| | | 25 | 26 | 27 | 28 |
| Catalyst No. | | C11 | C12 | C13 | C14 |
| Reaction zone of riser reactor 9 | Temperature, ° C. | 470 | 580 | 520 | 515 |
| | Pressure, MPa | 0.13 | 0.13 | 0.13 | 0.13 |
| | Contact time, sec | 3.5 | 3 | 3.3 | 3.3 |
| | Catalyst/Oil ratio | 6 | 8 | 7 | 7 |
| Temperature of outlet zone 13, ° C. | | 450 | 550 | 485 | 490 |
| Temperature of regenerator 20, ° C. | | 680 | 700 | 720 | 720 |
| Reduction reactor 3 | Temperature, ° C. | 600 | 680 | 700 | 680 |
| | Time, min | 30 | 30 | 30 | 30 |
| | Pressure, MPa | 0.12 | 0.12 | 0.12 | 0.12 |
| | Atmosphere containing a reducing gas | 80% $H_2$ + 20% $N_2$ | $H_2$ | $H_2$ | $H_2$ |
| | Amount of atmosphere containing a reducing gas, $m^3$/ton/min | 4.5 | 4.5 | 4.5 | 4.5 |
| Total amount of atomizing and pre-lifting steam relative to the amount of hydrocarbon oils, wt % | | 7 | 7 | 7 | 7 |
| Whether it is introduced into heat exchanger 7 to carry out heat exchange | | yes | Yes | yes | yes |
| Whether it is introduced into heat exchanger 24 to carry out heat exchange | | yes | No | No | No |

TABLE 10

| Example No. | 25 | 26 | 27 | 28 |
|---|---|---|---|---|
| Catalyst No. | C11 | C12 | C13 | C14 |
| Product distribution, wt % | | | | |
| Dry gas | 3.41 | 4.12 | 3.81 | 4.02 |
| LPG | 12.33 | 13.20 | 12.94 | 12.82 |
| Gasoline | 48.16 | 48.63 | 48.26 | 48.07 |
| Diesel oil | 26.79 | 25.26 | 26.53 | 25.76 |
| Heavy oil | 4.94 | 4.06 | 4.24 | 4.82 |
| Coke | 4.37 | 4.73 | 4.22 | 4.51 |
| Sulfur content in gasoline, ml/g | 100 | 150 | 130 | 180 |

EXAMPLES 29-31

The following examples describe the process of the present invention.

According to the scheme shown in FIG. 2, a mixed oil comprising 20 wt % of feedstock oil 2# and 80 wt % of feedstock oil 1# as shown in Table 4 was catalytically cracked. The cracking reactor 9 was a small scale riser reactor. The catalyst used were, respectively: (1) C15, a catalyst mixture comprising 80 wt % of an industrial catalyst under trademark of MLC-500 and 20 wt % of catalyst C1 prepared in example 1, wherein said industrial catalyst under trademark of MLC-500 contains rare-earth Y-zeolite, ultra-stable Y-zeolite, alumina and kaolin, and the content of the rare-earth oxide was 3.2 wt %; (2) C16, an industrial catalyst under trademark of CR022 comprising phosphor and rare-earth containing HY-zeolite, ultra-stable Y-zeolite, a zeolite having MFI structure, alumina and kaolin, and the content of the rare-earth oxide was 3.0 wt % and the content of phosphorus pentoxide was 1.0 wt %; (3) C17, a catalyst mixture of 95 wt % of an industrial catalyst under trademark of HGY-2000R and 5 wt % of catalyst C1 prepared in example 1, wherein said industrial catalyst under trademark of HGY-2000R contains rare-earth Y-zeolite, ultra-stable Y-zeolite, alumina and kaolin, and the content of rare-earth oxide is 2.1 wt %.

The catalyst that had contacted with an atmosphere containing a reducing gas from reduction reactor 3 was optionally introduced into heat exchanger 7 via line 6 to carry out heat exchange. The optionally heat-exchanged catalyst was introduced into pre-lifting section of riser reactor 9 via line 8. Said catalyst was driven by pre-lifting steam from line 10 to move upward into the reaction zone of riser reactor 9. Meanwhile, preheated hydrocarbon oil from line 11 was mixed with atomizing steam from line 12, and then introduced into the reaction zone of riser reactor 9, where said hydrocarbon oil contacted with the catalyst to carry out a cracking reaction. The reaction stream kept on moving upward through outlet zone 13 into disengager 15 of a separation system via horizontal pipe 14. The catalyst and cracked products were separated in disengager 15 by the cyclone separator. The separated catalyst, which is called a spent catalyst, was introduced into stripper 16 of the separation system where the spent catalyst contacted in counter flow with steam from line 17 to strip out cracked products remained on the spent catalyst. The separated cracked products and stripped products were mixed, and then discharged via line 18 to continue separating out various distillates in the separation system. After being stripped, the spent catalyst was introduced into regenerator 20 via sloped tube 19. In the regenerator 20, the spent catalyst contacted with an excessive amount of air from line 21 so that coke thereon was removed at a regeneration temperature, and the flue gas was vented off via line 22. The regenerated catalyst was optionally introduced into heat exchanger 24 via line 23 to carry out heat exchange, and the optionally heat-exchanged catalyst was introduced into gas displacement tank 26 via line 25. In gas displacement tank 26, the oxygen-containing gas entrained by the regenerated catalyst was displaced out with an inert gas from line 27, and waste gas was vented off via line 28. The gas-displaced catalyst was introduced into reduction reactor 3 via line 29 to contact with the atmosphere containing a reducing gas from line 4 under reduction conditions, and waste gas was vented off via 5. Operational conditions are shown in Table 11 and results are shown in Table 12.

COMPARATIVE EXAMPLE 4(DB4)

The following comparative example describes the reference process.

According to the method of example 29, the same feedstock oil were catalytically cracked by the same catalyst, except that the catalyst introduced into reduction reactor 3 did not contact with the atmosphere containing a reducing gas, namely that no atmosphere containing a reducing gas was introduced from line 4. Operational conditions are shown in Table 11 and results are shown in Table 12.

TABLE 11

| | | Example No. | | | |
|---|---|---|---|---|---|
| | | 29 | DB4 | 30 | 31 |
| Catalyst No. | | C15 | C15 | C16 | C17 |
| Reaction zone of riser reactor 9 | Temperature, ° C. | 515 | 515 | 510 | 510 |
| | Pressure, MPa | 0.18 | 0.18 | 0.18 | 0.18 |
| | Contact time, sec | 2.3 | 2.3 | 2.5 | 2.5 |
| | Catalyst/Oil ratio | 8 | 8 | 7 | 7 |
| Temperature of outlet zone 13, ° C. | | 500 | 500 | 495 | 495 |
| Temperature of regenerator 20, ° C. | | 700 | 700 | 700 | 700 |
| Reduction reactor 3 | Temperature, ° C. | 530 | — | 520 | 520 |
| | Time, min | 30 | — | 30 | 30 |
| | Pressure, MPa | 0.15 | — | 0.15 | 0.15 |
| | Atmosphere containing a reducing gas | 50% $H_2$ + 50% dry gas | — | 50% $H_2$ + 50% dry gas | 50% $H_2$ + 50% dry gas |
| | Amount of atmosphere containing a reducing gas, $m^3$/ton/min | 4 | — | 4 | 4 |
| Total amount of atomizing and pre-lifting steam relative to the amount of the hydrocarbon oils wt % | | 13 | 13 | 13 | 13 |
| Whether it is introduced into heat exchanger 7 to carry out heat exchange | | No | Yes | No | No |
| Whether it is introduced into heat exchanger 24 to carry out heat exchange | | Yes | Yes | Yes | Yes |

TABLE 12

| Example No. | 29 | DB4 | 30 | 31 |
|---|---|---|---|---|
| Catalyst No. | C15 | C15 | C16 | C17 |
| Product distribution, wt % | | | | |
| Dry gas | 3.02 | 3.12 | 2.71 | 3.52 |
| LPG | 11.83 | 11.95 | 11.41 | 12.42 |
| Gasoline | 42.64 | 43.33 | 43.65 | 43.41 |
| Diesel oil | 28.54 | 23.47 | 27.16 | 25.30 |
| Heavy oil | 6.22 | 7.96 | 7.44 | 7.62 |
| Coke | 7.75 | 10.17 | 7.63 | 7.73 |
| Sulfur content in gasoline, ml/g | 300 | 900 | 310 | 340 |

It can be seen from Table 12 that, compared with the comparative process not having the step of reduction, by catalytically cracking sulfur-containing hydrocarbon oil according to the process of the present invention, the yields of gasoline and diesel oil in cracked products increase prominently, the yields of heavy oil and coke decrease prominently, and sulfur content in gasoline decreases to a large extent. The results further show that the process of the present invention has much higher ability of cracking and desulfurizing heavy oil.

The present application claims priority under 35 U.S.C. §119 of Chinese Patent Application No. 03126446.8 filed on Sep. 28, 2003. The disclosure of the foregoing application is expressly incorporated by reference herein in its entirety.

The invention claimed is:

1. A process for cracking hydrocarbon oils, characterized in comprising, under cracking conditions, contacting a hydrocarbon oil with a catalyst that has been contacted with an atmosphere containing a reducing gas, separating cracked products and the catalyst, regenerating the catalyst, contacting the regenerated catalyst with said atmosphere containing a reducing gas, wherein said hydrocarbon oil is a sulfur-containing or sulfur-free hydrocarbon oil, said catalyst is a cracking catalyst containing metal components or a catalyst mixture of a cracking catalyst containing metal components and a cracking catalyst free of a metal component, said metal component is present in a reduction valence state, the ratio of average valence to maximum oxidative valence of said metal is 0-0.7, based on said cracking catalyst containing metal components and calculated by oxide of the metal component present in the maximum oxidative valence state, the content of metal component is 0.1-30 wt %, and said metal component is one or more metals selected from the group consisting of non-aluminum metals of Group (IIIA), metals of Group (IVA), Group (VA), Group (IB), Group (IIB), Group (VB), Group (VIB) and Group (VIIB), non-noble metals of Group (VIII) in the Periodic Table of Elements and rare-earth metals; said catalyst contacted with the atmosphere containing a reducing gas at a temperature of 100 to 900° C. for at least 1 second, the amount of the atmosphere containing a reducing gas being not less than 0.03 cubic meters of the reducing gas per ton of the cracking catalyst containing a metal component per minute, and the catalyst contacted with said atmosphere containing a reducing gas at a pressure of 0.12-0.5 MPa.

2. The process according to claim 1, characterized in that cracking reactor is a fixed-bed reactor, a fluidized bed reactor, a moving-bed reactor or a riser reactor.

3. The process according to claim 1, characterized in that cracking conditions include a reaction temperature of 350-700° C., a reaction pressure of 0.1-0.8 MPa, and a catalyst/oil ratio of 1-30.

4. The process according to claim 3, characterized in that cracking conditions include a reaction temperature of 400-650° C., a reaction pressure of 0.1-0.5 MPa, and a catalyst/oil ratio of 2-15.

5. The process according to claim 1, characterized in comprising contacting a hydrocarbon oil with a catalyst in a riser reactor under cracking conditions, separating cracked products and the catalyst, circulating the catalyst to a regenerator for regeneration, circulating the regenerated catalyst to a reduction reactor, contacting the regenerated catalyst with an atmosphere containing a reducing gas in the reduction reactor, circulating the catalyst that has contacted with the atmosphere containing a reducing gas back to the riser reactor, wherein said hydrocarbon oil is a sulfur-containing or sulfur-free hydrocarbon oil, said catalyst is a cracking catalyst containing a metal component or a catalyst mixture of the cracking catalyst containing a metal component and a cracking catalyst free of a metal component, said metal component is present in a reduction valence state, the ratio of average valence to maximum oxidative valence of said metal is 0-0.7, based on said cracking catalyst containing a metal component and calculated by oxide of the metal component in the maximum oxidative valence state, the content of metal component is 0.1-30 wt %, said metal component is one or more metals selected from the group consisting of non-aluminum metals of Group (IIIA), metals of Group (IVA), Group (VA), Group (IB), Group (IIB), Group (VB), Group (VIB) and Group (VIIB), non-noble metals of Group (VIII) in the Periodic Table of Elements and rare-earth metals; said catalyst contacted with the atmosphere containing a reducing gas at a temperature of 100-900° C. for at least 1 second, the amount of the atmosphere containing a reducing gas being not less than 0.03 cubic meters of the reducing gas per ton of the cracking catalyst containing a metal component per minute, and the pressure of the reduction reactor being 0.12-0.5 MPa.

6. The process according to claim 5, characterized in comprising: optionally introducing a catalyst that has been contacted with an atmosphere containing a reducing gas from reduction reactor (3) into heat exchanger (7) via line (6) to carry out heat exchange; introducing the optionally heat-exchanged catalyst into a pre-lifting section of riser reactor (9) via line (8); driving said catalyst by pre-lifting steam from line (10) to move upward into the reaction zone of riser reactor (9), meanwhile, mixing a preheated hydrocarbon oil from line (11) with atomizing steam from line (12) and introducing them into the reaction zone of riser reactor (9), where said hydrocarbon oil contacts with the catalyst to carry out a cracking reaction under cracking conditions; keeping on moving reaction stream upward through outlet zone (13) into disengager (15) of the separation system via horizontal pipe (14), where the catalyst and cracked products are separated in disengager (15) by the cyclone separator; introducing the separated catalyst, which is called a spent catalyst, into stripper 16 of the separation system, to contact in counter flow with steam from line (17) and strip out cracked products remained on the spent catalyst; mixing the separated cracked products with stripped products, and then discharging the resultant mixture via line 18 to continue separating various distillates in the separation system; introducing the stripped spent catalyst into regenerator (20) via sloped tube (19), wherein the spent catalyst contacts with an oxygen-containing atmosphere from line 21 so that coke thereon is removed at a regeneration temperature; and venting flue gas off via line (22); optionally introducing the regenerated catalyst into heat exchanger (24) via line (23) to carry out heat exchange; introducing the optionally heat-exchanged catalyst into reduction reactor 3 via line (25), where the regenerated catalyst or the mixture of the regenerated catalyst and a fresh catalyst via line (2) from tank (1) contacts with an atmosphere containing a reducing gas from line (4) under reduction conditions, and venting the waste gas off via line (5).

7. The process according to claim 5, characterized in comprising: optionally introducing a catalyst that has been contacted with an atmosphere containing a reducing gas from reduction reactor (3) into heat exchanger (7) via line (6) to carry out heat exchange; introducing the optionally heat-exchanged catalyst into a pre-lifting section of riser reactor (9) via line (8); driving said catalyst by pre-lifting steam from line (10) to move upward into the reaction zone of riser reactor (9), meanwhile, mixing a preheated hydrocarbon oil from line (11) with atomizing steam from line (12) and introducing them into the reaction zone of riser reactor (9), where said hydrocarbon oil contacts with the catalyst to carry out cracking reaction; keeping on moving the reaction stream upward through outlet zone (13) into disengager (15) of the separation system via horizontal pipe (14), where the catalyst and cracked products are separated in disengager (15) by the cyclone separator; introducing the separated catalyst, which is called a spent catalyst, into stripper (16) of the separation system to contact in counter flow with steam from line (17) and strip out cracked products remained on the spent catalyst; mixing the separated cracked products with stripped products, and then discharging the resultant mixture via line (18) to continue separating various distillates in the separation system; introducing the stripped spent catalyst into regenerator (20) via sloped tube (19), where the spent catalyst contacts with an oxygen-containing atmosphere from line (21) so that coke thereon is removed at a regeneration temperature; and venting flue gas off via line (22); optionally introducing the regenerated catalyst into heat exchanger (24) via line (23) to carry out heat exchange; introducing the optionally heat-exchanged catalyst into gas displacement tank (26) via line (25) to displace off the oxygen-containing gas entrained by the regenerated catalyst or the mixture of the regenerated catalyst and the fresh catalyst from tank (1) via line (2) with an inert gas from line (27); and venting the waste gas off via line (28); introducing the gas-displaced catalyst into reduction reactor (3) via line (29) to contact with the atmosphere containing a reducing gas from line (4) under reduction condition; and venting the waste gas off via (5).

8. The process according to claim 6, characterized in that said process further comprises decreasing the temperature of outlet zone in the riser reactor by gas-solid rapid separation method or by injecting a chilling agent via line (30) into the region connecting outlet zone 13 with the reaction zone of riser reactor (9).

9. The process according to claim 6, characterized in that the total amount of the atomizing steam and the pre-lifting steam is 1-30% by weight of the hydrocarbon oil.

10. The process according to claim 7, characterized in that said inert gas is one or more selected from the group consisting of nitrogen, carbon dioxide, or Group zero gas in the Periodic Table of Elements and the amount of said inert gas is 0.01-30 cubic meters per ton of catalyst per minute.

11. The process according to claim 5, characterized in that said cracking conditions include a reaction zone temperature of 350-700° C. and an outlet temperature of 350-560° C. in riser reactor, a reaction pressure of 0.1-0.5 MPa, a contact time of 1-10 seconds and a Catalyst/Oil weight ratio of 3-15.

12. The process according to claim 11, characterized in that said cracking conditions include a reaction zone temperature of 450-600° C. and an outlet temperature of 450-550° C. in riser reactor, a reaction pressure of 0.1-0.3 MPa, a contact time of 1-6 seconds and a Catalyst/Oil weight ratio of 4-10.

13. The process according to claim 1 or 5, characterized in that the catalyst contacts with the atmosphere containing a reducing gas at a temperature of 400-700° C. for 10 seconds to 1 hour under a pressure of 0.12-0.3 MPa with an amount of 0.05-15 cubic meters of the reducing gas per ton of the cracking catalyst containing a metal component per minute, wherein said atmosphere containing a reducing gas refers to a pure reducing gas or an atmosphere containing a reducing gas and an inert gas.

14. The process according to claim 13, characterized in that said pure reducing gas includes one or more gases selected from hydrogen, carbon monoxide and hydrocarbons containing 1-5 carbon atoms; said atmosphere containing a reducing gas and an inert gas include mixtures of one or more selected from hydrogen, carbon monoxide, hydrocarbons containing 1-5 carbon atoms or one or more of inert gases, or a dry gas from refining factory.

15. The process according to claim 13, characterized in that said inert gas refers to one or more selected from gases of Group zero in the Periodic Table of Elements, nitrogen, and carbon dioxide.

16. The process according to claim 13, characterized in that the content of the reducing gas is at least 10% by volume of said atmosphere containing a reducing gas.

17. The process according to claim 1, characterized in that, based on said catalyst mixture, the content of the cracking catalyst containing a metal component is at least 0.1 wt %.

18. The process according to claim 17, characterized in that, based on said catalyst mixture, the content of the cracking catalyst containing a metal component is at least 1 wt %.

19. The process according to claim 1, characterized in that said cracking catalyst containing a metal component contains a molecular sieve, a refractory inorganic oxide matrix, a clay and a metal component, wherein, based on the total amount of said cracking catalyst containing a metal component, the content of said molecular sieve is 1-90 wt %, the content of the refractory inorganic oxide is 2-80 wt %, the content of the clay is 2-80 wt %, and the content of the metal component is 0.1-30 wt % calculated by oxide of metal in the maximum oxidative valence state, said metal component is one or more metals selected from the group consisting of non-aluminum metals of Group (IIIA), metals of Group (IVA), Group (VA), Group (IB), Group (IIB), Group (VB), Group (VIB) Group (VIIB), and non-noble metals of Group (VIII) of the Periodic Table of Elements.

20. The process according to claim 19, characterized in that said metal component is present in the molecular sieve, refractory inorganic oxide and clay.

21. The process according to claim 19, characterized in that said metal component is present in the refractory inorganic oxide and/or clay.

22. The process according to claim 19, characterized in that the ratio of average valence to maximum oxidative valence of said metal is 0.1-0.7.

23. The process according to claim 19, characterized in that said metal component is one or more metals selected from the group consisting of gallium, germanium, tin, antimony, bismuth, led, copper, silver, zinc, cadmium, vanadium, molybdenum, tungsten, manganese, iron, cobalt and nickel.

24. The process according to claim 19, characterized in that the catalyst further contains a rare-earth metal, wherein said rare-earth metal is present in the form of a metal and/or a compound thereof, and the content of the rare-earth metal component is 0-50 wt %, based on the total amount of the cracking catalyst containing a metal component and calculated by oxide.

25. The process according to claim 24, characterized in that, based on the total amount of the cracking catalyst containing a metal component and calculated by oxide, the content of said rare-earth metal component is 0-15 wt %.

26. The process according to claim 19, characterized in that said catalyst further contains a phosphor component, wherein the content of said phosphor component is 0 to 15 wt %, based on the total amount of the cracking catalyst containing a metal component and calculated by phosphorus pentoxide.

27. The process according to claim 19, characterized in that said molecular sieve is one or more selected from the group consisting of Y-zeolites, phosphorus- and/or rare-earth-containing Y-zeolites, ultra-stable Y-zeolites, phosphorus- and/or rare-earth-containing ultra-stable Y-zeolites, beta zeolites, zeolites having MFI structure, phosphorus-and/or rare-earth-containing zeolites having MFI structure.

28. The process according to claim 19, characterized in that said refractory inorganic oxide is one or more selected from the group consisting of alumina, silica, amorphous silica/alumina, zirconia, titania, boron oxide, and oxides of alkaline earth metals.

29. The process according to claim 19, characterized in that said clay is one or more selected from the group consisting of kaolin, halloysite, montmorillonite, kieselguhr, halloysite, soapstone, rectorite, sepiolite, attapulgus, hydrotalcite, and bentonite.

30. The process according to claim 1, characterized in that said hydrocarbon oil is sulfur-containing or sulfur-free hydrocarbon oil having less than 50 ppm of metal impurities.

31. The process according to claim 30, characterized in that said hydrocarbon oil is a sulfur-containing hydrocarbon oil having less than 50 ppm of metal impurities.

32. The process according to claim 13, characterized in that the catalyst contacting with said atmosphere containing a reducing gas at a pressure of 0.12-0.23 MPa.

* * * * *